2/16/82 OR 4,316,250

United States Patent [19]

Vincent

[11] 4,316,250

[45] Feb. 16, 1982

[54] DIP DETERMINATION BY STATISTICAL COMBINATION OF DISPLACEMENTS

[75] Inventor: Philippe Vincent, Chilly Mazarin, France

[73] Assignee: Schlumberger Technology Corporation, New York, N.Y.

[21] Appl. No.: 94,596

[22] Filed: Nov. 15, 1979

Related U.S. Application Data

[63] Continuation of Ser. No. 544,421, Jan. 27, 1975, abandoned.

[30] Foreign Application Priority Data

Jan. 30, 1974 [FR] France ..... 74 03003

[51] Int. Cl.[3] ..... G06F 15/20; E21B 47/00

[52] U.S. Cl. ..... 364/422; 324/339; 324/351

[58] Field of Search ..... 364/300, 422; 324/323, 324/339, 351; 340/853

[56] References Cited

U.S. PATENT DOCUMENTS

| | | | |
|---|---|---|---|
| 2,973,472 | 2/1961 | Egan et al. | 324/351 |
| 3,077,670 | 2/1963 | Waters | 324/351 |
| 3,127,509 | 3/1964 | Swift | 324/323 |
| 3,466,532 | 9/1969 | Kolb | 324/323 |
| 3,521,154 | 7/1970 | Maricelli | 324/351 |

*Primary Examiner*—Jerry Smith

*Attorney, Agent, or Firm*—Cooper, Dunham, Clark, Griffin & Moran

[57] ABSTRACT

Disclosed are a process and a system which relate to well logging, to converting logs to dips of subsurface formations and to producing a new type of a map record of dips. The map record conforms to a plane which is transverse to the borehole and contains a number of map line representations the position of each of which conforms to a range of dips consistent with the displacement between two similar reflections on respective well logging signals. The displacements relate to reflections on logging signals at borehole depths within an interval which is small as compared to the depth of the entire borehole, and the predominant locus of intersections of such line representations on the map record determines a likely dip of a subsurface feature which is in the borehole depth interval of interest.

26 Claims, 28 Drawing Figures

RECORDER
41
34B
39
40
SIGNAL PROCESSING CIRCUITS
SIGNAL CONDITIONING
31
34A
34
42
30
SIGNAL GENERATOR
52
32
SIGNAL CONVERSION
50
60
SIGNAL CORRELATION FOR DISPLACEMENTS
62
10
B
70
B
74
REPRESENT POSSIBLE DIPS FOR EACH DISPLACEMENT
78
76
FIRST INTERVAL?
YES
NEXT INTERVAL
NO
13
17
18
80
DETERMINE POSITION OF COINCIDENT DIPS
15
82
DETERMINE FORMATION DIP FROM POSITION
16
20
90
OUTPUT DIP
48
A'o
45
22
Ao
19
14
95
48
RECORDER

Fig. 8.
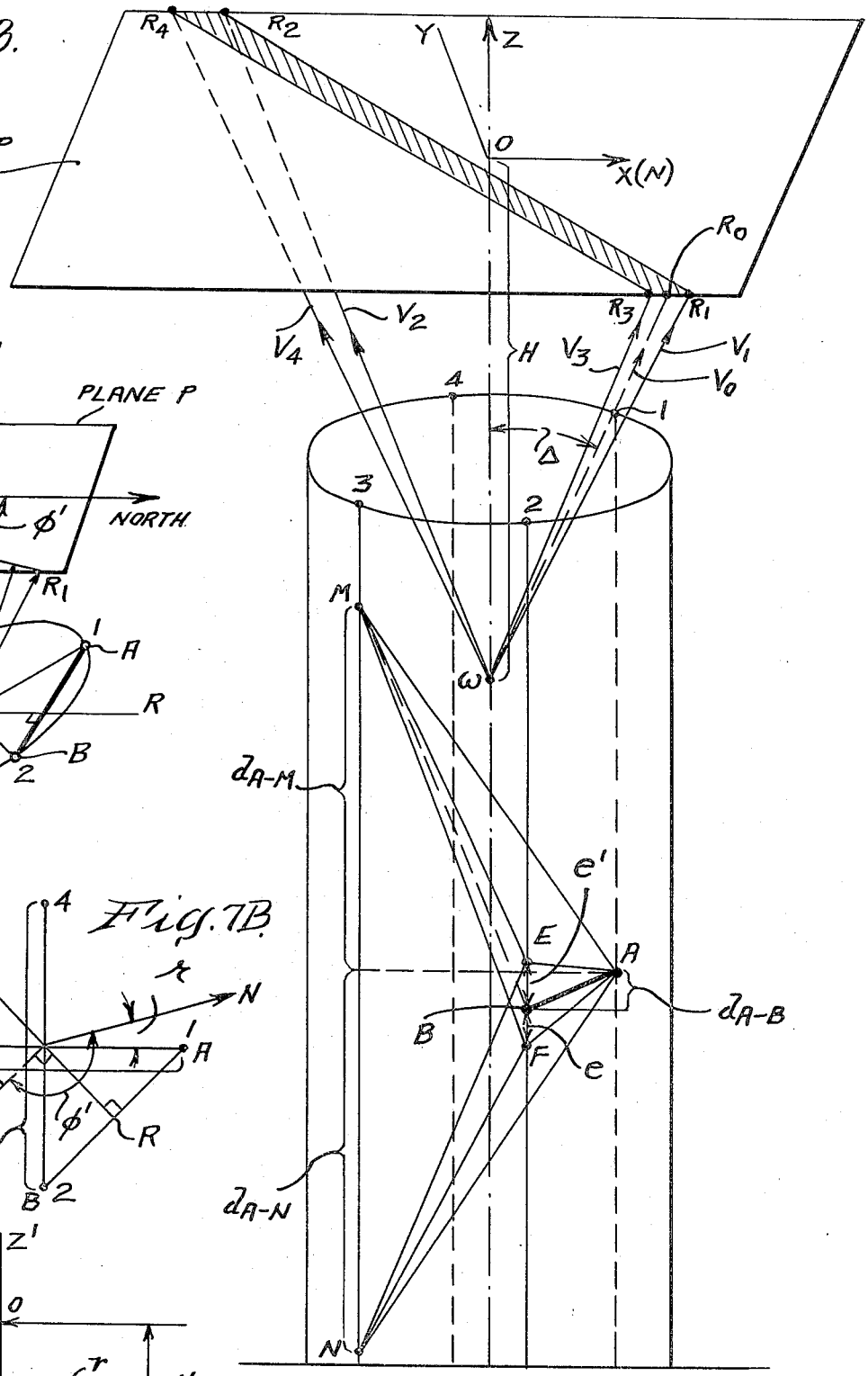
Fig. 7A.
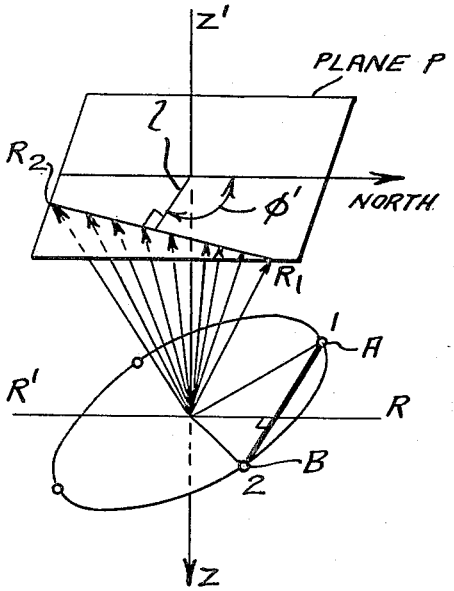
Fig. 7B.
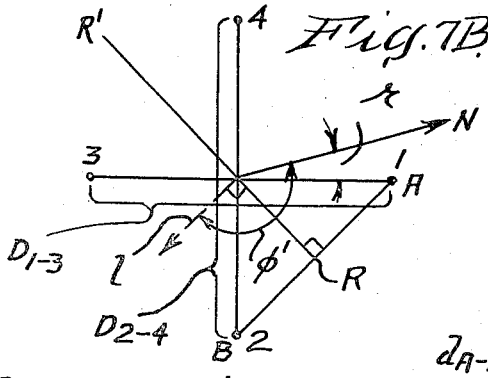
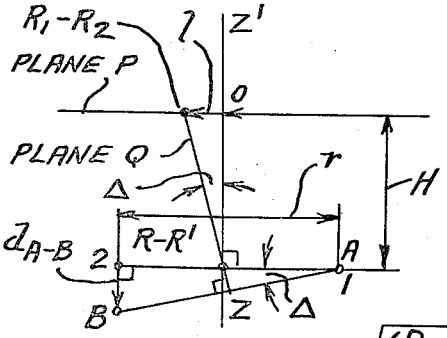
$$\tan(\Delta) = \frac{d_{A-B}}{r}$$
$$\tan(\Delta) = \frac{l}{H}$$
$$l = \frac{H d_{A-B}}{r} = C d_{A-B}$$
$$r = \sqrt{\left(\frac{D_{1-3}}{2}\right)^2 + \left(\frac{D_{2-4}}{2}\right)^2}$$
$$r \approx D/\sqrt{2}$$
Fig. 7C.

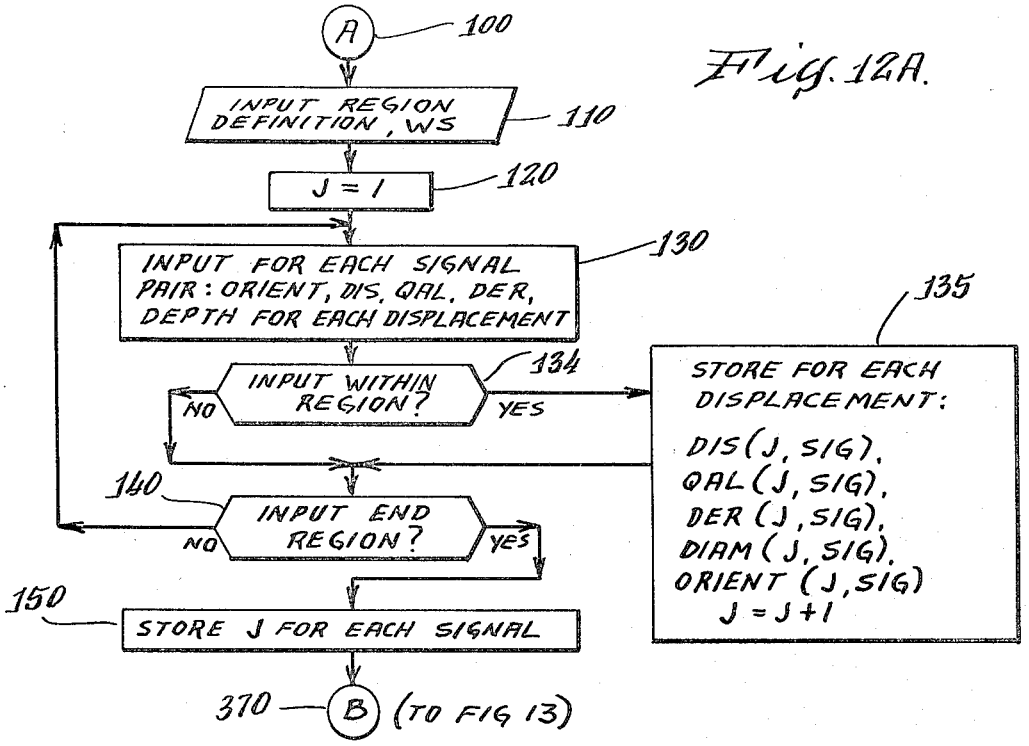
Fig. 12A.
Fig. 12B.
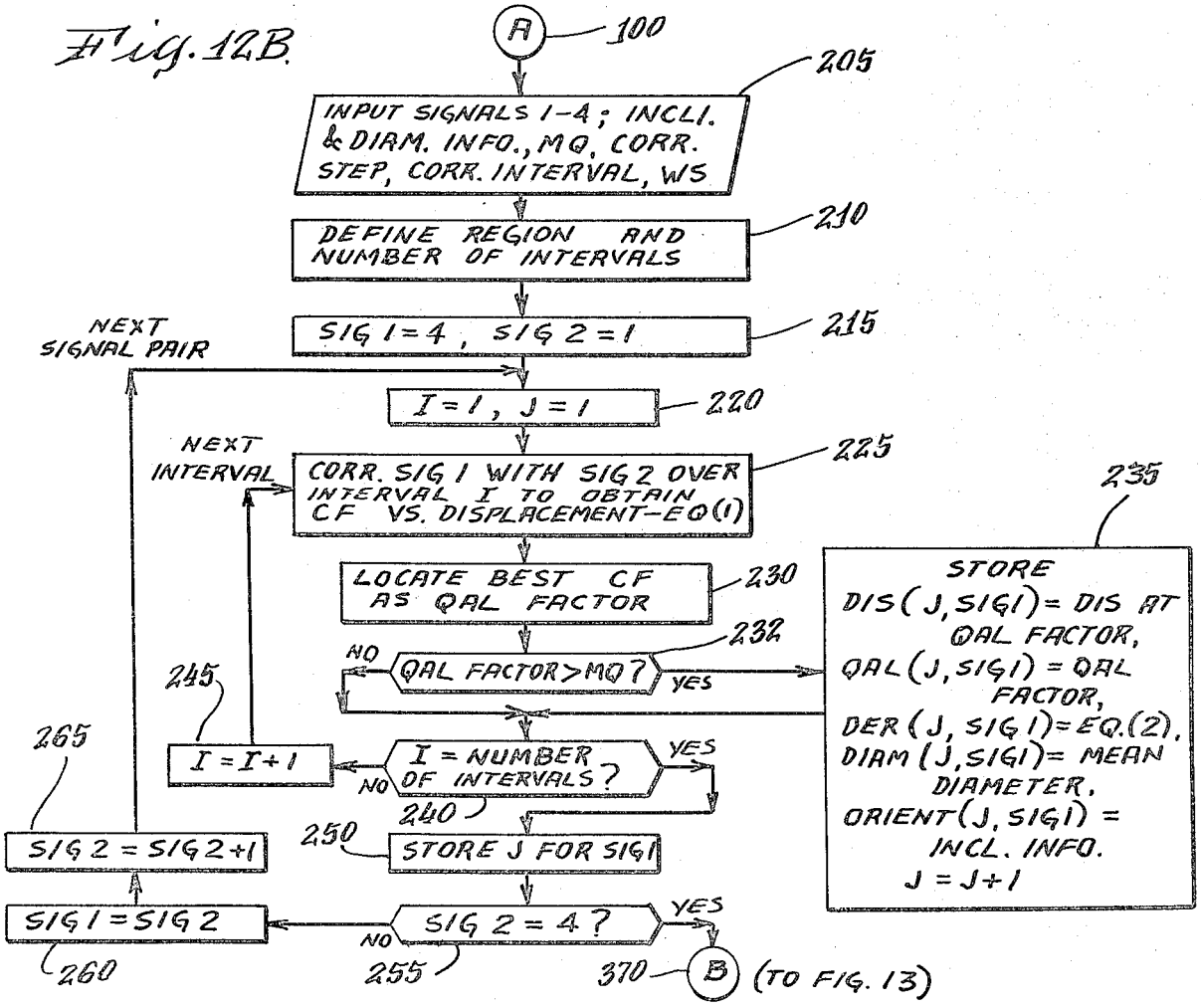

DIP DETERMINATION BY STATISTICAL COMBINATION OF DISPLACEMENTS

This is a continuation, of application Ser. No. 544,421 filed Jan. 27, 1975 and now abandoned.

BACKGROUND OF THE INVENTION

This invention relates generally to techniques used in geophysical well logging, and more particularly to new techniques for automatically processing dipmeter signals or displacement measurements obtained between these signals to produce more accurate dip and aximuth representations of subsurface formations.

A common method of measuring the dip angle and direction or azimith of subsurface formations employs a dipmeter tool passed through a borehole drilled into the subsurface formations. This tool may apply any of numerous means to obtain geophysical signals representative of variations of a particular formation characteristic, such as its resistivity. One such tool is described in the paper: "The High Resolution Dipmeter Tool", by L. A. Allaud and J. Ringot, published in the May–June 1969 issue of *The Log Analyst.*

Dip and azimuth measurements representing the inclination of a formation characteristic or feature may be determined from dipmeter signals containing information representing the intersection of such a feature at three or more radially spaced points on the borehole surface. The displacement between two points intersecting a common feature may be determined, under favorable circumstances, by correlating pairs of the dipmeter signals, each having a similar response to the common feature. Two displacements between three related points determine the position of a plane. The position of the plane is conveniently expressed by its dip $\theta$, an angle measured from a reference (usually horizontal) plane and its azimuth $\Phi$, an angle measured from a reference direction (usually true North).

Typically, the dipmeter signals are recorded on computer compatible magnetic tape at the well site for later processing. The recorded signals are processed using any of several techniques. Manual, semi-automatic and fully automatic processing may be used with the automatic processing being performed with either analog or digital computers. When digital computers are used, a computer program is also required.

A computer program to perform the digital processing operations is described in a paper, "Automatic Computation of Dipmeter Logs Digitally Recorded on Magnetic Tape" by J. H. Moran, et al and published in the July, 1962 issue of the *Journal of Petroleum Technology.* An additional computer program is described in the paper, "Computer Methods of Diplog Correlation" by L. G. Schoonover, et al, pages 31–38, published in the February 1973 issue of *Society of Petroleum Engineers Journal.* Further, programs to process digitally-taped dipmeter data may be obtained from digital computer manufacturers, such as IBM.

Results from digital processing are normally presented in tabular listings as dip and azimuth measurements versus borehole depth. When desired, the individual displacements found between the correlated curve pairs which led to the dip and azimuth values may also be presented. Further, most such programs will provide the ability to vary both the length of the correlation interval and the step used to move this interval between each correlation sequence. For the next sequence, the same correlation length is used, but the actual interval correlated is moved by one correlation step length.

At each step or depth level, one sequence of displacements between various pairs of signal combinations may be obtained. A typical sequence includes at least two displacements but may include a round of up to six displacements in each sequence when four separate signals are employed, for example. When a round of more than two displacements in one sequence is obtained, the displacements may be combined into many more possibly different combinations, each combination corresponding to perhaps a different dip and azimuth measurement. Since only two related displacements are required, it is common practice to utilize only what appears to be the two best qualified displacements. All others are discarded without further consideration, thereby producing only one result per sequence. Further, little is retained as to the accuracy or quality of either the discarded or the utilized displacements.

When large numbers of measurements result, as from recent high resolution dipmeter techniques, tabular listings are usually augmented by graphic presentations of dip and aazimuth representations. The graphic displays vary with the interpretation objective, depending upon whether the purpose is for stratigraphic or structural studies. Accordingly, relationships between the corresponding dip and azimuth measurements and their continuity with depth are considered in different manners.

Graphic displays used in stratigraphic analysis are typically the azimuth frequency plot (no dip or depth representation) and the Schmidt net and the Stereonet (azimuth versus dip but still no depth representation). These nets and several variations thereof have known statistical characteristics in that they may enhance either low or high dip measurement point groupings. Note that in their use, the dip and azimuth value for each measurement is combined and represented by a point in these nets. A description of some of these displays and their application is given in the paper "Stratigraphic Applications of Dipmeter Data in Mid-Continent" by R. L. Campbell, Jr., published in September 1968 in the *American Association of Petroleum Geologists Bulletin.*

Stratigraphic and structural analyses distinguish themselves in the type of information needed. In stratigraphic analysis, the dipmeter signals hopefully represent bedding planes within the boundaries of a given geological unit. These bedding planes have little, if any, regional extent. In structural analysis, a deliberate attempt may be made to mask out such sedimentary features in favor of enhancing the boundaries of the individual strata.

Short lengths (1 to 2 or 3 feet) of dipmeter signals are correlated to obtain stratigraphic information while long lengths (10 to 20 or 30 feet) of signals are often correlated to obtain structural information. While use of long correlation lengths to obtain structrual dip has been standard practice for some time, there are certain disadvantages associated with this practice. One is that the use of long correlation lengths masks dip patterns needed for stratigraphic analysis, thus additional computations must be made using a short length to obtain stratigraphic information. Another is that most long correlation length techniques may be influenced by frequently occurring stratigraphic features having a common dip and direction, even though each such feature is less pronounced than the structural feature. Thus, the use of long correlation lengths does not assure obtaining accurate structural dip information. Yet another disadvantage is that such correlation techniques tend to ignore possibly objectionable effects of rotation of the dipmeter tool within the long correlation interval.

The preferred approach is to obtain the detailed information available only from short signal intervals and then apply previously mentioned trend analysis to separate the stratigraphic and structural dips. However, as the correlation interval is shortened, the probability of obtaining a completely erroneous displacement increases substantially. The wrong peak on the correlation function produced in the correlation process may be used to determine the displacement. Such invalid displacements may be combined with valid displacements and produce an erroneous dip which add scatter and confuse valid trends or when systematically erroneous, may even appear as false trends.

As a compromise, longer correlation intervals than are actually desired are employed to artificially reduce this scatter to an acceptable level so that any valid trend which may be present might be found.

It is therefore an object of this invention to provide a technique to reduce the scatter in dip and azimuth measurements used in determining structural dip.

One technique which is employed to reduce scatter and find structural dip is to average long intervals of dip measurements obtained from much shorter intervals. Unfortunately, valid structural trends present only for short intervals may be masked completely by such an averaging process. Further, the resolution, quality and correlogram peak position obtained by correlating short intervals tends to vary considerably; consequently, the corresponding displacements may lack accuracy. Certain combinations of such displacements may compound the variation and introduce unacceptable inaccuracies in the resulting dip and azimuth measurements.

It is therefore an additional object of the present invention to provide a technique to improve the accuracy and reduce the scatter of dip and azimuth measurements without necessitating long interval averaging.

Some of the averaging techniques include a preliminary process of sorting or discarding apparently stray dips before averaging to prevent their contributing to the average. This process adds both time delays and expense to a process which already produces too few dips for many purposes. Further, some of the apparent strays may actually be part of a valid trend which was unfortunately just sampled infrequently. Both the discarding and averaging processes suppress such valid dips. Still further, the apparently stray dip may have been produced by combining a valid displacement with an invalid displacement. Unfortunately, discarding this dip also discards the valid displacement information.

It is therefore a further object of the present invention to provide a technique to minimize the likelihood of discarding valid displacement information combined with invalid or inaccurate displacements.

As previously discussed, there are prior art techniques for statistically analyzing either the dip or azimuth information for long interval trends. These methods usually employ polar chart representations to classify the dip and/or azimuth measurements. In these plots, the dip varies with distance from either the center or the edge of the plots and the azimuth varies with the radial distribution from the center of the plot.

However, when one considers the type of errors likely to take place in the correlation processes, particularly in deviated holes, it is desirable that any analysis not separate the dip from the azimuth values for the purposes of the analysis. The analysis should be able to detect any interrelationship between the dip and azimuth for the individual measurements. More particularly, the analysis should respect the fact that an erroneous displacement can be concealed when combined with another displacement and expressed as a dip and azimuth measurement.

It is therefore a further object of the present invention to provide a technique for analyzing displacements rather than combinations of displacements or the resulting dip or azimuth measurements.

Prior art methods do attempt to select only the best displacements or combinations thereof by assigning a quality rating according to the correlation process which determined the displacement. The best rated displacements are selected while discarding poor quality displacements. The best rated displacements may be distorted or exaggerated due to failure of the signal source to maintain its proper position in the borehole, while poorer rated displacements may be obtained from sources in a much better position to produce more accurate displacements.

It is therefore a particular object of the present invention to provide a technique to retain even apparently poor quality or less accurate displacements, as they may in fact be valid, until a better basis for judging the validity of these displacements is available, thereby preventing premature loss of this information.

There are numerous methods of obtaining displacement measurements between pairs of geophysical signals. It is well known how to use one of several different correlation functions to produce a correlogram—a function representing the correlation factor, likeness or similarity of signal features in given intervals of two signals versus the displacement measured between the intervals. The displacement corresponding to the best correlation or likeness is usually selected as the displacement measurement and the corresponding correlation factor or likeness used to express the quality. Also, the shape of the correlogram adjacent to this best correlation factor is related to the displacement measurement accuracy.

Another correlation method of obtaining displacements recognizes characteristic signal features by their patterns and determines which features on both pairs of signals correspond to one another by comparing those characteristics. Each comparison yields a quality factor; the best comparing pattern determines the feature correspondence and displacement, and the nature of a characteristic of the pattern (for example, the rate of change in signal amplitude) provides a measure of displacement accuracy. Thus, with a variety of techniques available to determine displacement measurements between pairs of signals, the corresponding quality factors and some measure of displacement accuracy, it is desirable to have a general technique to process these displacements which is relatively independent of the technique used to obtain these measurements.

It is therefore an object of the present invention to provide a general technique to process displacement measurements to determine the dip of a formation and, particularly, to provide a technique which utilizes to advantage the quality factor and displacement accuracy information corresponding to each such displacement when available.

in accordance with these and other objects of the present invention, apparatus and methods are provided which automatically determine with a machine the dip of a formation feature reflected on geophysical signals derived from signal sources located at different positions in a borehole penetrating subsurface formations. The dip is determined by processing displacements obtained between pairs of these signals. These displacements may be obtained by comparing similarities of the signal features in a given interval of the signals. Each displacement is represented by its possible dips. At least two displacements obtained between different intervals of at least one pair of geophysical signals are so represented. The position of coincidence between these possible dip representations is determined along with the corresponding dip of a formation feature.

In one embodiment of the invention, the possible dip representations correspond to a line projected in a plane normal to the borehole or, if the axis of the borehole varies substantially over the intervals considered, the mean axis of the borehole. The orientation of the line is determined from the orientation of the signal sources in the borehole. The distance between the line and the intersection point of the borehole axis with the plane represents the range of possible dip values for the displacement and depends upon the magnitude of the displacement. When two different displacements corresponding to the same formation but measured with different orientations relative to features of the formation are so represented, their line representations intersect. The intersection point corresponds to the actual dip of the formation and its orientation corresponds to the azimuth of this dip. Displacements between various signal pairs within a particular interval and within at least one additional nearby interval are represented by such lines. When several intersections at different positions occur, the position of the highest coincidence of intersections is determined as corresponding to a more accurate formation dip than might be determined by combining only two displacements.

In one aspect of the invention, a quality is associated with each displacement and used to control the intensity or weight of the line representation. For a given line width, the highest intensity line corresponds to the best quality displacement. Therefore, the intensity or weight of the line intersections will vary not only with the number of lines intersecting at the same position, but also with the quality associated with displacements represented by these lines. The position of the most intense intersection determines the most accurate formation dip.

In another aspect of the invention, a displacement accuracy or error factor is associated with each displacement and used to control the line width accordingly. Wider lines represent less accurate displacements while narrower lines represent more accurate displacements. The intensity of the lines representing the same quality factor is decreased for the wider lines and increased for the narrower lines; i.e., the intensity is inversely proportional to the line width. In this embodiment, the intensity of the line intersections varies not only with the number of coincident intersections but also with both the accuracy and quality of the displacements they represent. Again, the most intense intersection corresponds to the most accurate dip.

Since all the displacements which may be obtained at a given depth level between the various pair combinations of two or more signals may be represented as well as the displacements from nearby depth levels, a large number of displacements may be represented in the same plane. All the displacements corresponding to the same formation dip intersect at substantially the same position. Therefore, the position corresponding to the highest coincidence of line intersections most accurately represents the dip of this formation.

Further, since invalid and inaccurate displacements will not consistently intersect at the same position as the valid displacements, no penalty is imposed by representing all displacements regardless of their apparent quality or accuracy. Therefore, there is not need to prematurely and perhaps, somewhat arbitrarily, pass judgment on each displacement in order to determine only the two best rated displacements required to determine the formation dip in the prior art techniques. Rather, all displacements are processed without regard to apparent quality or accuracy except as mentioned above to vary the line width and intensity. Furher, the formation dip may be determined and confirmed by substantially more than two displacements. Still further, these displacements may have been obtained between unrelated pairs of signals or between the same pair of signals but at different nearby intervals or depth levels.

In highly deviated holes characteristically employed to exploit offshore oil and gas producing formations, the ability to obtain accurate formation dips from apparently inaccurate or poor quality displacement measurements is an important advantage since signal measurement problems associated with deviated boreholes often contribute to inaccuracies and misleading quality factors for displacement measurements between signals obtained in different sectors of the borehole. For example, the signal obtained from the signal source in good contact with the borehole wall may not contain the same signal features as a signal obtained from a signal source not in contact with the borehole wall, because of mechanical problems associated with maintaining the desired source position in such highly deviated holes.

Displacements associated with poorly positioned signal sources are often distorted. Further, it is difficult to detect when such distortion occurs. For example, the quality factors associated with such distorted displacements are often of the best quality factors in a particular interval. However, in accordance with the features of the present invention, the displacement representations of such distorted displacements will not intersect at substantially the same position; i.e., they are scattered in accordance with their varying distortion, and accordingly, do not coincide with the intersections of valid displacements.

A further advantage of the present invention occurs when only two signal sources contain reliable signal features, the remaining sources suffering from signal distortion or attenuation problems. In such cases, the prior art techniques requiring two displacements over corresponding intervals on three different signals must attempt to utilize one of the bad signals in order to produce any results whatsoever. However, in utilizing the present invention, it is possible to obtain useful results under certain circumstances with only two signals.

In addition to the above advantages, the techniques of the present invention may be used to preserve the displacement integrity information for consideration in the displacement processing in a manner which enhances the determination of the dip corresponding to the more accurate and better quality displacements. This is carried out by varying the effect of each displacement representation in accordance with the associated quality factor and/or displacement accuracy. For a given displacement representation, the weight the displacement contributes to the dip determination is increased for the higher integrity displacements, while decreased for the lower integrity displacements. This allows each displacement to possibly contribute in some degree to the dip determination.

For a better understanding of the present invention, together with other and further objects thereof, reference is had to the following description taken in connection with the accompanying drawings, the scope of the invention being pointed out in the appended claims.

BRIEF DESCRIPTION OF THE FIGURES

FIG. 7A illustrates one technique for representing as a line in Plane P the many possible dip vectors corresponding to a displacement between Points A and B.

FIG. 7B illustrates in a plane normal to the borehole and including line R-R' shown in FIG. 7A certain relationships pertaining to the orientation and representation of a displacement representation.

FIG. 7C illustrates in a view along line R-R' shown in FIGS. 7A and 7B one way the displacement between A and B—$d_{A-B}$—may be represented in Plane P.

FIG. 8 illustrates a technique to vary the line with respresenting a Displacement $d_{A-B}$ in accordance with a displacement error range of $-e'$ to $+e$ and therefore, uncertainties in the position of B relative to A varying between E and F.

FIG. 12A illustrates how displacements corresponding to different intervals and different signal pairs within a given region, along with associated depth, quality and error factors may be produced as input to a subsequent process.

FIG. 12B illustrates how the input illustrated in FIG. 12A may be produced by a technique employing correlation functions, correlograms, etc.

Referring now to FIG. 1, there is illustrated a method of acquiring and processing signals obtained from a borehole investigating device commonly known as a dipmeter. This device is described in one form in U.S. Pat. No. 3,521,154 issued July 21, 1970 to J. J. Maricelli. The purpose of the dipmeter device is to obtain signals from three or more radially spaced sources usually in the form of pads which contact the borehole wall. Signals obtained from such sources reflect formation features at their intersection with the borehole wall and are useful in determining the orientation of the formations penetrated by the borehole.

Figure 1:
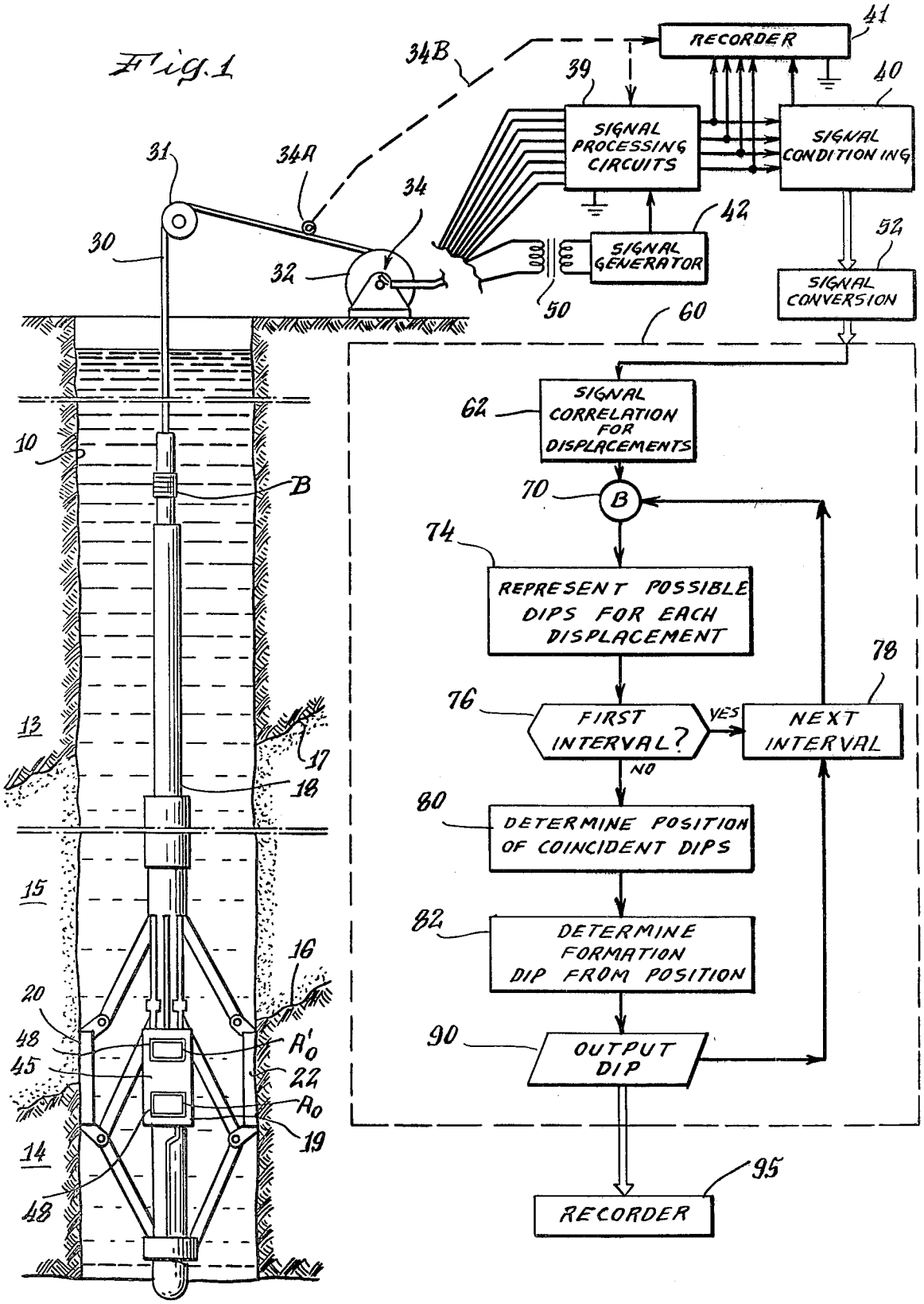
FIG. 1 illustrates a method and apparatus for producing dip-meter signals, obtaining displacements between pairs of these signals and processing these displacements in accordance with one form of the invention.

Typical earth formations are represented by the shale formations 13 and 14 shown in FIG. 1, and intervening sand formation 15. Typical formation features are boundaries 16 and 17 shown between these formations.

As shown in FIG. 1, the borehole apparatus 18 is lowered on cable 30 into a borehole 10 for investigating the earth's formations. The downhole investigating device 18 is adapted for movement through the borehole 10 and as illustrated, includes four pads designated 19, 20, 21 and 22 (the front pad 19 obscures the view of back pad member 21 which is not shown).

The pad members 19 through 22 are adapted to derive measurements at the wall of the borehole. Each pad includes a survey electrode shown as Ao. One of the pads, herein designated as pad 19, may contain an additional survey electrode Ao' useful in determining the speed of the tool. Each survey electrode is surrounded by an insulating material 48. The insulating material and thus all the survey electrodes are surrounded by a main metal portion 45 of the pad. The metal portion 45 of each pad, along with certain other parts of the apparatus, comprise a focussing system for confining the survey current emitted from each of the different survey electrodes into the desired focussed pattern. Survey signals representative of changes in the formation opposite each pad are obtained from circuits comprising Ao electrodes, focussing elements, and a current return electrode B shown in FIG. 1.

The upper end of the borehole tool 18 as shown in FIG. 1 is connected by means of an armored multiconductor cable 30 to a suitable apparatus at the surface for raising and lowering the downhole investigating device through the borehole 10. Mechanical and electrical control of the downhole device may be accomplished with the multiconductor cable which passes from the downhole tool 18 through the borehole to a sheave wheel 31 at the surface and then to a suitable drum and winch mechanism 32.

Electrical connections between various conductors of the multiconductor cable, which are connected downhole to the previously described electrodes, and various electrical circuits at the surface of the earth are accomplished by means of a suitable multi-element slip-ring and brush contact assembly 34. In this manner, the signals which originate from the downhole investigating device are supplied to the signal processing circuits 39 which in turn supply the signals to a signal conditioner 40 and recorder 41. A suitable signal generator 42 supplies current to the downhole tool via transformer 50 and to a signal processing circuits located at the surface. More details of such circuits are described in the aforementioned Maricelli patent.

Signals obtained from the downhole device may be recorded graphically by a film recorder 41. One such recorder is described in U.S. Pat. No. 3,453,530 issued to G. E. Attali on July 1, 1969. In addition, the signals may be processed to obtain discrete samples and recorded on digital tape. A suitable digital tape recorder is described in U.S. Pat. No. 3,648,278 issued to G. K. Miller, on Mar. 7, 1972.

The signals may be sampled by driving sampling devices, such as those described in the above-mentioned digital tape recorder, by the cable motion as measured at the surface. For example, the cable length measuring wheel shown as 34A in FIG. 1 may be used in controlling the signal processing, sampling and recording subcycles as indicated by signal line 34B. Therefore, each sample of a measured signal corresponds to one increment in depth and displacements determined between such sample signals are indicative of depth displacements.

The dipmeter signals or samples thereof may also be transmitted directly to a computer. The computer may be located at the well site or the signals may be transmitted via a transmission system to a remote computer location. One transmission system which may be used is described in U.S. Pat. No. 3,599,156 issued to G. K. Miller, et al on Aug. 10, 1971.

The recorded or transmitted signals may be processed as digital measurements by general purpose digital computing apparatus properly programmed in a manner to perform the processes described herein or by special purpose computing apparatus composed of modules arranged to accomplish the described steps to accomplish the same process.

Alternatively, as shown in FIG. 1, the signals may be processed directly at the well site, using conventional digital computing apparatus 60 when properly programmed and interfaced to the signal conversion means 52. One such computing apparatus is the Model PDP-11/45 obtainable from the Digital Equipment Corporation. Suppliers of such equipment may also supply signal conditioning circuits 40 and signal conversion means 52 suitable for conditioning and converting analog signals to digital samples for subsequent digital storage and processing. Further, such computing apparatus ordinarily includes a memory for storing data and information such as parameters, coefficients and controls used and generated by the processing steps.

A brief description of one process which may be performed at the well site by such a computer 60 when properly programmed is illustrated by Blocks 62 through 90 of FIG. 1. Other processes will be described in detail in relation to additional FIGS. 12A through 14.

Referring now to Block 62 of FIG. 1, the correlation of signals to obtain displacements may correspond to a variety of methods. One method, for example, is the prior art employment of a correlation function to derive a correlogram of correlation factors versus displacement. The displacement corresponding to the best likeness or correlation factor, providing the correlation factor exceeds at least a minimum quality, is usually used. The correlation function is applied over selected intervals of each signal with the selected interval on one signal being progressively displaced relative to the other to derive the correlogram for a series of displacements. The process then may be repeated for a different interval on the base signal and different intervals of the other signal to derive another correlogram and obtain another displacement between the same pair of signals. In a similar manner additional displacements for additional intervals may be obtained between other pairs of signals or combinations thereof. In this manner, sequences of displacements for different signal intervals and different combinations of signals may be derived.

In another method correlation, more particularly described in U.S. patent application Ser. No. 362,160 filed by the Applicant on May 21, 1973 and now abandoned, correlations between characteristic signal elements corresponding to common recognizable features are determined. Specific types of characteristic elements are detected and their boundary positions and characteristic parameters recorded. Compatible types of elements are located on a pair of signals and compared to determine corresponding elements. Displacements are provided by the relative positions between the elements on one signal and the corresponding element on the other signal. Similarly, for a different element corresponding to a different interval on one signal, different corresponding elements and displacements may be obtained on the other signal. Thus, it will be appreciated that the techniques of the present invention may be applied to displacements obtained from different methods of correlation.

It is well known that two related displacements; i.e., two displacements taken between different combinations or pairs of three signals, each pair having one signal in common, and corresponding to the same depth interval, may be employed to determine the dip and azimuth of a formation feature reflected on signals corresponding to that interval. This prior art practice corresponds to the well known fact that any three points known relative to each other may be used to define a plane. Thus, prior art displacement processing techniques characteristically combine pairs of related displacements to define dip and azimuth values. Despite considerable effort to select only the two best qualifying displacements to determine this dip and azimuth, there remains the distinct possibility that at least one and perhaps both displacements are in error. In either case, the resulting dip will also be in error.

In the Applicant's technique it is unnecessary to combine displacements to produce dip values. Rather, each displacement may be processed independently of each other displacement. Each displacement is regarded simply as a range of possible dip values, that range including, of course, the correct dip if the displacement is in fact valid. When a number of displacements are so represented, the ranges of possible dips will overlap and narrow the number of dip possibilities. When a substantial number of displacements from different intervals and with different orientations are represented, a single dip possibility is indicated by the position of coincidence in the range of possible dips. This coincidence position may be determined; therefore, the dip with the most frequent occurrence in the represented possibilities also determined.

Thus, referring to FIG. 1, beginning at Point B, designated as 70 therein, Block 74 corresponds to representing possible dips corresponding to each displacement. As discussed above, these possible dips include a range of values which includes, if the displacement is a valid one, the actual formation dip. Since, however, the actual formation dip cannot be determined from a single displacement, and as indicated in Block 76, additional displacements will be required, and a test is made to determine if displacements from only a first interval have been represented. This will be the case after processing only one interval and the test indicated in Block 76 will answer YES. The process will continue as indicated in Block 78 to consider the next interval and begin again at Point B. As just described, each displacement in this interval will also be represented as the range of possible dips that it might correspond to. Now, however, when the test indicated in Block 76 is performed, the answer will be NO and the process will continue as indicated in Block 80 of FIG. 1.

In the next procedure, the position of the highest coincidence of the possible dip representations is determined. The nature of this determination depends somewhat on the methods used to represent each displacement. In the simplest case, where each displacement is represented by a single line of uniform width and intensity, the position of coincidence corresponds to the position having the highest number of line intersections. When the representations are varied in width and line weight or intensity, the position is determined by the position having the highest weight or intensity, by virtue of the superposition or overlapping and therefore, the accumulation of the line weights.

Once the above position has been determined as indicated in Block 80 of FIG. 1, the corresponding formation dip may be determined. Since the relationships used to represent the possible dips may also be used to determine the dip corresponding to the position of coincident representations, determination of the formation dip is usually a straightforward procedure. If, however, the borehole is substantially deviated from the vertical, well known corrections may be applied to determine the true formation dip, rather than the apparent dip which would be derived in this case in the process indicated in Block 82. Then, as indicated in Block 90, the true formation dip, usually expressed as a dip and azimuth value, may be output for recording on Recorder 95. Thereafter, if desired, the next interval may be considered in the above described process with additional formation dips resulting.

The above described process may be performed with the aid of a digital computer 60 programmed in accordance with the steps shown in FIG. 1. When performed at the well site, it may be desirable to record and/or display the dips resulting such processing on Recorder 95 connected to the digital computer 60. Recorder 95 may be a digital tape recorder, or have display capabilities such as a printer, plotter or CRT recorder. The nature and use of these devices is well known and will not be further described herein.

When recorder 95 is a digital tape recorder of the type previously mentioned in regard to Recorder 41, it may then serve as an intermediate storage facility to record the results for later conversion to graphic displays. Where transmission facilities to remote locations are available, these facilities may be used in lieu of the recorder and the output displayed at another location and perhaps at another time. Of course, it will be appreciated that the transmission facilities may be employed to transmit any or all of the input or intermediate results to a remote processing facility for further processing and display.

In review, FIG. 1 illustrates the steps of a method for automatically determining with a computer the dip of a formation through features reflected on geophysical signals obtained from a dipmeter. These signals may be correlated using a number of methods to obtain displacements between pairs of these signals, as for example, by comparing the similarity of signal features in given intervals of the signals. These displacements are represented in the form of the many possible dips corresponding to a single displacement. When many displacements, for example, from several intervals, are so represented, the formation dip may be determined by the position corresponding to the highest coincidence of possible dips.

Prior art techniques combined necessarily related displacements to obtain formation dips. The technique of the present invention treats each displacement independently. Therefore, it becomes unnecessary to eliminate all but the two best displacements or qualify the displacements which may be combined. Rather, all displacements may be considered in the process without penalty. Still further, valid displacements may not be inadvertently combined with an invalid displacement to produce an erroneous dip. By processing the displacements without combining them, judgments as to quality, accuracy and validity may be deferred until a number of displacements provide a better basis for these decisions.

Figure 2:
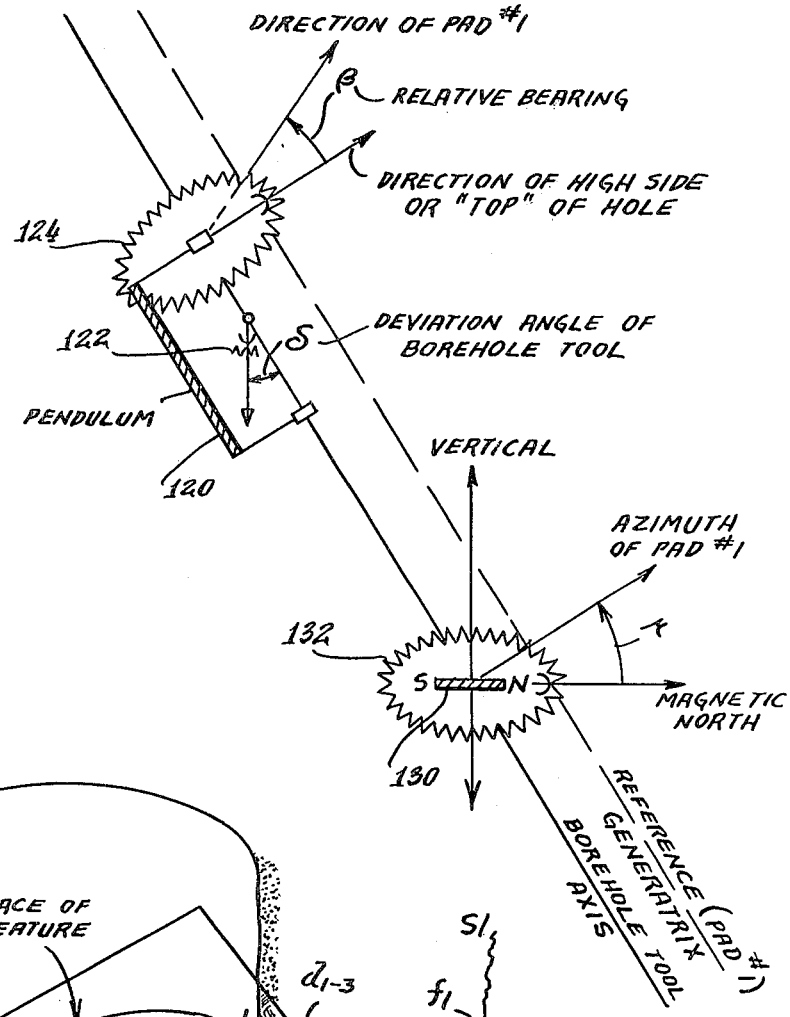
FIG. 2 illustrates how certain references relative to the borehole tool are measured.

Referring now to FIG. 2, a brief description will be given of how certain reference information characterizing the position of the borehole tool, and therefore the sources of the signals, is measured. Incorporated within the apparatus 18 shown in FIG. 1 is an inclinometer system, schematically illustrated in FIG. 2. The inclinometer system is referenced to one of the signal sources, usually the pad designated as No. 1. The inclinometer system is composed of two related measuring systems. One system contains a pendulum 120 suspended in relation to the center line or axis of the borehole tool such that it establishes a vertical plane in which to measure the deviation angle $\delta$ of the borehole tool. This may be done as illustrated in FIG. 2, for example, by measuring with a second pendulum and a potentiometer 122, the angular deviation of the tool axis from this vertical pendulum. This deviation is sometimes known as the drift angle. The first pendulum 120 is also related in a rotational sense to the position of the reference pad. An additional potentiometer shown as 124 in FIG. 2 may be used to measure the rotational angle $\beta$ between the reference pad and pendulum 120 position. This angle $\beta$ is usually measured from the high side or the top of the hole and is known as the relative bearing. It is conventional to measure this angle such that it has a positive sign when measured clockwise from the high side of the hole to pad No. 1.

An additional system incorporates a magnetic compass 130 and another potentiometer 132 such that the potentiometer measurement reflects the angle by which the referenced pad differs from magnetic North as measured by the compass 130. As shown in FIG. 2, this angle $\mu$ corresponds to the azimuth of the number 1 pad. Thus, it may be seen how the position of a reference point on the tool, here shown as pad No. 1, may be related both to magnetic North, as expressed by its azimuth, and to the top of the hole, as expressed by its relative bearing and deviation angle.

It is readily apparent then that any measurement which is referenced to the position of pad No. 1 may be also referenced to the top of the hole or to magnetic North which of course may be converted to geographic North. Still further, it will be apparent how the position of the top of the hole and magnetic North may be referenced to pad No. 1. It is well known how to use these reference measurements. Further details may be obtained, for example, in the aforementioned Moran, et al paper, particularly in the appendix thereof.

Figure 3:
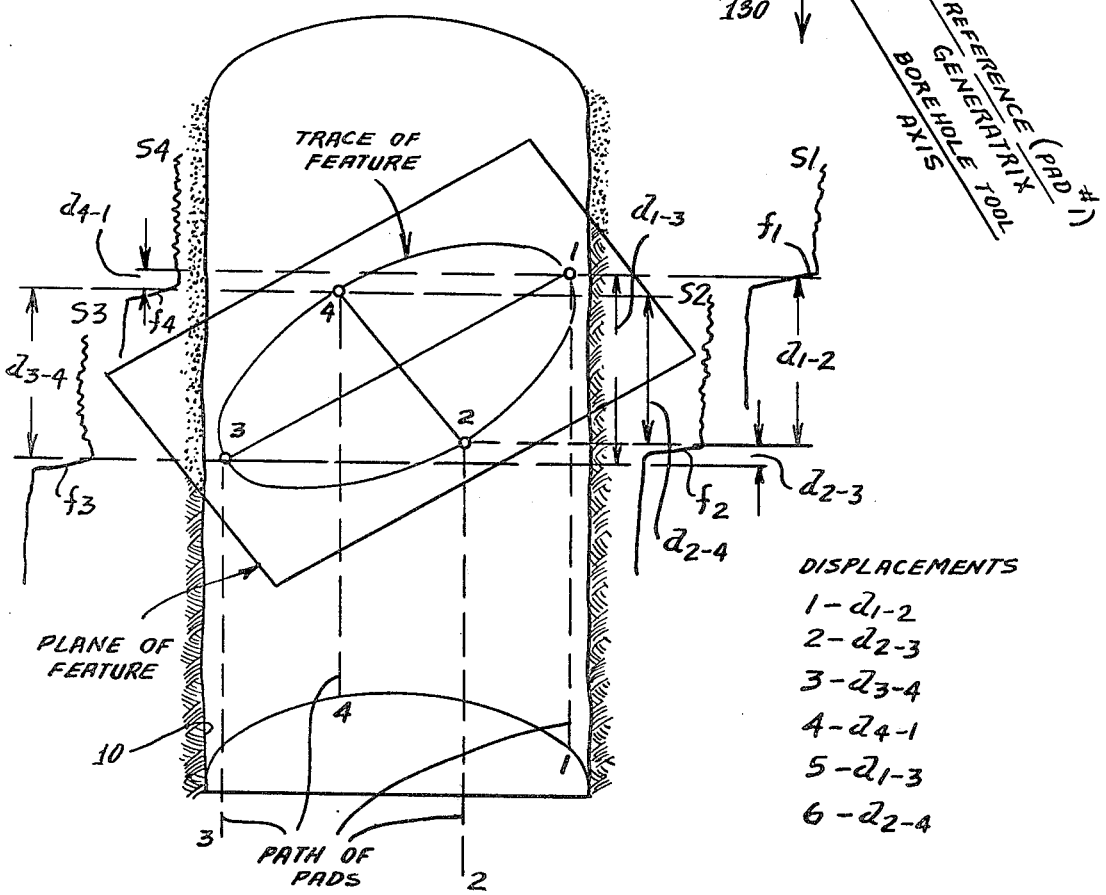
FIG. 3 shows how displacements obtained between similar characteristics on pairs of geophysical signals derived at spaced positions in a borehole are related to the plane of a formation feature intersecting the borehole.

Referring now to FIG. 3, there are illustrated the four pads of the dipmeter tool shown in FIG. 1, designated here as 1, 2, 3 and 4. As the dipmeter tool 18 moves up the borehole 10, the four pads each trace a path on the borehole wall as indicated in FIG. 3 by the dashed vertical lines. These paths will intersect the plane of a formation feature at the borehole wall at the four points indicated by small circles 1 through 4. Further, the nature of the pad suspension system for the dipmeter assures that these paths trace opposite sides of the borehole for each diagonally opposing pair of pads, for example, pad pairs 1 and 3, or 2 and 4.

The signal response for each of the four pads is shown in FIG. 3 as S1 through S4. The change in the character of the signals corresponding to the feature which intersects the borehole is shown as signal features $f_1$ through $f_4$. When the plane of the feature is inclined relative to the borehole as shown in FIG. 3, there will be a displacement between the corresponding features on each signal. As shown, one pad will respond to the feature first as the tool is withdrawn from the borehole, with the opposite pad responding last. In FIG. 3, these pads correspond to Pads 3 and 1, respectively.

The correlation process which hopefully recognizes the correspondence of these points, may then be used to determine the displacement between the points of intersection of the feature with the paths of the pads along the borehole wall. For example, the correlation of S1 and S2 determines the displacement between Points $f_1$ and $f_2$. As illustrated in FIG. 3, Pad 2 intersected the feature plane at a deeper depth than Pad 1. Thus, the depth of the $f_1$ on S1 is less than the depth of $f_2$ on S2. By convention, the displacement between S1 and S2 is therefore considered to be negative. This is consistent with the notation that the displacement between two signal features equals the depth of the feature on the signal from the first pad minus the depth of the feature on the signal from the second pad. As shown in FIG. 3, the displacement between intersection point for the feature at $f_1$ on S1 and $f_2$ on S2 is designated $d_{1-2}$ and as shown, is negative, since $f_1$ is above $f_2$. More details as to conventions will be given in regard to FIGs. 6A–6G.

Three additional displacements similar to that obtained between the adjacent Pads 1 and 2 may be obtained by correlating S2 with S3, S3 with S4 and S4 with S1. These four adjacent displacements are designated accordingly, as $d_{1-2}$, $d_{2-3}$, $d_{3-4}$, and $d_{4-1}$. Two additional displacements may be obtained to complete a full round of displacements for this level or sequence by correlating the signals obtained from diagonally opposing pads. In the case of the four-pad tool illustrated in FIG. 3, these diagonals correspond to $d_{1-3}$ and $d_{2-4}$. Thus, for the illustrated four-pad tool, there are six possible displacements which may be obtained by correlating the four signals. There are, of course, other dipmeter tools which may have different numbers of pads, for example, the three-pad tool from which, because of the 120° angular relationship between the pads, no diagonal displacements may be obtained.

It is well known that the position of any three points provide the definition of a plane, which in the dipmeter art is expressed as the depth, dip and azimuth of the plane. Of course, in addition to the above described displacements between signal features, the radial distance between the measure points on pads corresponding to these signals, is also needed to define the required three points. In the four pad tool, these radial distances are obtained from the two diameters measured between opposing pads. Thus, any two related displacements and corresponding diameters define the three points and may be used to produce a dip and azimuth value. Even in the three-pad configuration, where there are only three possible displacement determinations, an extra displacement is apparent, and in fact, three different combinations of displacements pairs are possible, providing the redundancy of three different azimuth and dip determinations.

In the illustrated four-arm dipmeter tool, where six displacement determinations are possible along with two separate diameter measurements; i.e., along the diagonals 1–3 and 2–4, a multiplicity of combinations exist and, as can be readily shown, provide the possibility of up to thirteen different dip and azimuth values. Ideally, all of the above multiplicity of possibilities would yield the same dip and azimuth value. Unfortunately, limitations inherent to the correlation process and to the measurement environment in the borehole provide ample opportunity for one or more of the combinations to be in error.

In fact, it is possible that all combinations of displacements are in error, yet one or even two of the displacements could be entirely correct. For example, if displacements $d_{1-2}$ and $d_{3-4}$ were correct, the prior art practice of combining these displacements with other adjacent or diagonal displacements, which, if invalid, would cause these combinations to be also invalid. In contrast, the present invention provides a technique for utilizing these valid displacements without the necessity of combining them for purposes of analysis, with other possibly invalid displacements and therefore contaminating them with errors from these other displacements, thereby permanently preventing them from making any constructive contribution.

It is useful to appreciate the types of errors which may occur in the correlation process and, consequently, affect the validity, quality and accuracy of the resulting displacements. While many of these errors have their counterparts in any correlation procedure, consider first the procedure which results in a correlogram such as illustrated in FIG. 4.

Figure 4:
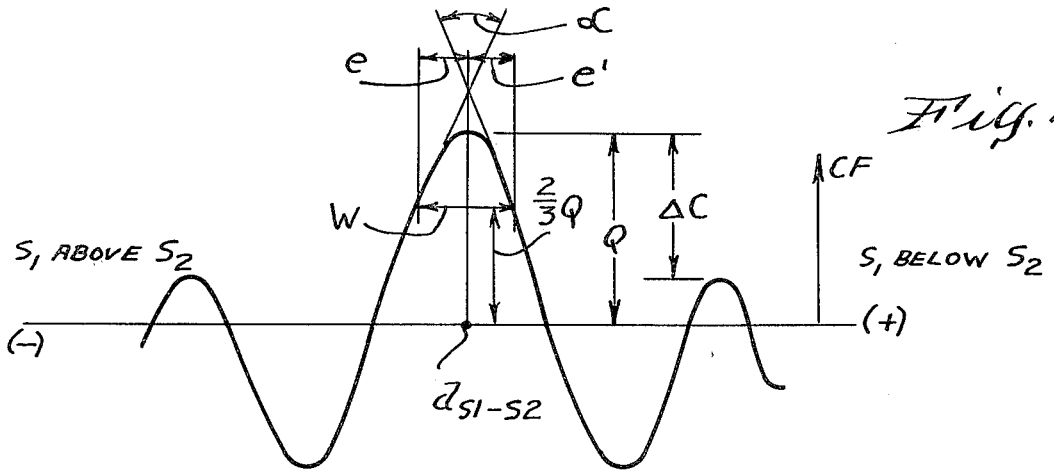
FIG. 4 illustrates the general characteristics of a correlogram in terms of correlation quality, displacement and displacement accuracy determination.

Refer now to FIG. 4 where there is shown a correlogram such as may be derived by applying a correlation function to a given number of samples in a sample interval on two signals, S1 and S2.

One correlation function which produces a normalized correlogram; i.e., one in which the values of the correlation factor CF is a function of the quality of the correlation, as for example, where a CF value of 100 represents a perfect likeness between the correlated signal intervals; a 0, no similarity whatsoever; and a −100, a perfect non-likeness, as for example, where a maximum on one signal corresponds to a minimum on the other. An equation for such a correlation function is as follows:

$$CF_j = 100 \frac{\Sigma S_i \cdot S'_{i+j}}{\sqrt{\Sigma S_i^2} \cdot \sqrt{\Sigma S'^2_{i+j}}} . \quad \text{(Eq. 1)}$$

The sample index i is varied over the correlated interval, while the displacement j is varied over the possible corresponding displacements between the intervals. Thus, a sequence of CF values is obtained versus displacement j such as shown in FIG. 4. The displacement between signals S1 and S2 is usually taken at the maximum value of CF. It will be appreciated that if the peak associated with this maximum is quite sharp there is little doubt as to the position of the maximum and therefore the displacement. However, if the peak is relatively flat, a larger uncertainty exists as to the position of the maximum and similarly the displacement; i.e., a larger displacement error could be possible. There are several ways in which a displacement error may be expressed using correlograms. As illustrated in FIG. 4, a range of displacements may be determined by following the correlogram to the left and to the right of the maximum until the correlation factor CF decreases by some given amount. For example, if the maximum corresponds to a value of Q, the extent of the displacement range might be determined by the first occurrence of the value ($\frac{2}{3}$Q), and as such would be illustrative of the width of the correlogram at this height. As shown in FIG. 4, the range of displacements determined in this manner correspond to $d_{S1-S2}$ −e to +e′, to the left and to the right of the peak, respectively. Since the peak may not be symmetrical, e need not equal e′. While it is possible to consider separately such non-symmetrical displacement error ranges when practicing the techniques of this invention, for simplicity in explanation, an average error may be computed from:

$$e = (|e| + |e'|)/2 \quad \text{(EQ. 2)},$$

where |e| designates the absolute value of e. The illustrated value of ($\frac{2}{3}$Q) used to determine e and e′ may of course be varied, as for example, PC·Q may be used where the preferred value of PC may be 0.9.

In the above illustrated method, e is related to width W of the correlogram at PC·Q and through the use of Equation 2, represents an average value which is a function of the correlogram's shape and therefore of the displacement determination accuracy. This method of expressing displacement determination accuracy is only illustrative. Other methods may also be used. For example, the slope of the correlogram may be determined on each side of the best CF point, perhaps at the inflection point and the difference in slope, illustrated as $\alpha$, in FIG. 4 related to e. A still further example would be the use of the difference between the maximum CF and the next possible maximum, such as illustrated by ΔC in FIG. 4. Suffice it to say that any reasonable method of determining displacement accuracy from correlograms may be used.

Besides the displacement determination accuracy problem common to nearly all correlation procedures, there is another type of displacement determination problem which may be characterized as a miscorrelation. Here, rather than exact displacement being a matter of accuracy, it is a matter of trying to select which of several possible signal features within the interval being correlated actually correspond to one another. Unfortunately, the similarity between these features may in fact be quite close. In the correlogram approach, two "best" correlation factors may appear, and the selection of the correct one may depend on the small arbitrary differences in the correlogram. This problem is further complicated by the necessity in the prior art techniques to provide the unique displacement for each correlogram. It is an advantage of the present invention that more than one displacement may be considered between a particular signal pair within a given interval. It is now possible to consider two or more possible displacements obtained from a single correlogram where little distinction assures the proper selection of the correct displacement. As will be further explained hereafter, when a number of possible similar features exist on one signal which could correspond to a given feature on another signal, each possible correspondent and its displacement may be considered. It is preferred, however, in such cases, that the weight which would have been given a distinctly unique displacement be distributed in accordance with the quality of each of the possible displacements.

Figure 5A:
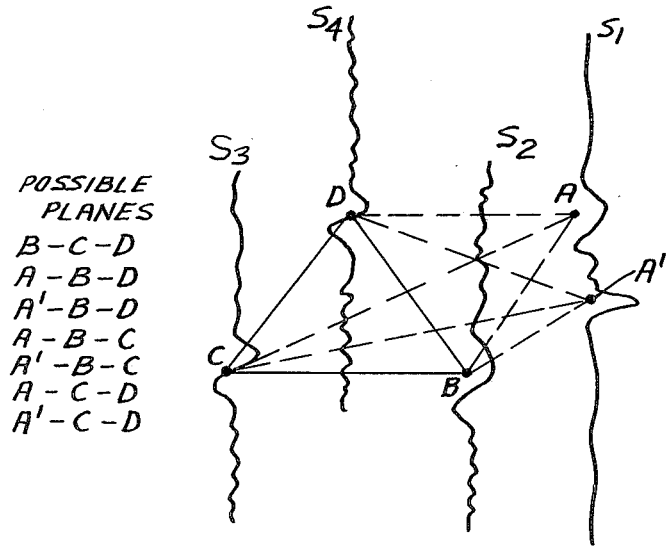
FIG. 5A illustrates possibly corresponding displacements between two similar signal elements, A and A', on one signal with similar signal elements, B through D, on various other signals.

Referring now to FIG. 5A, there are shown the four signals which may be obtained from the four-pad tool. The signals designated S2, S3 and S4 are very similar and each contains a common feature labeled B, C and D on each of the signals respectively. The signal designated as S1 contains not only this feature, here designated as A, but an additional feature designated as A′. Thus, as illustrated, there is a a question as to whether the Feature A or A′ corresponds to the unique Features B through D on the other signals. As illustrated in FIG. 5A, unique Features B, C and D accurately and unambiguously define plane B-C-D. However, when the Features A and A′ on S1 are taken in conjunction with B and D, two additional planes, A-B-D and A′-B-D are defined; and similarly, with B and C, planes A-B-C and A′-B-C are defined; and with C and D, planes A-C-D and A′-C-D are defined.

Figure 5B:
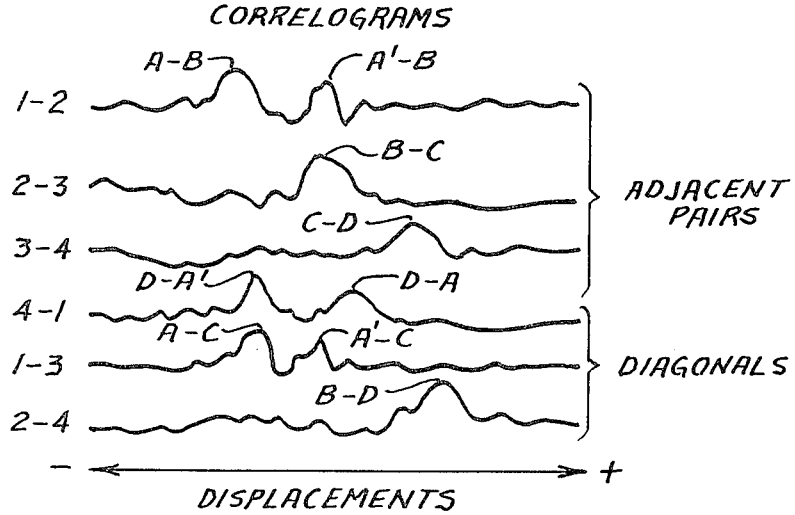
FIG. 5B shows correlograms related to the possibly corresponding displacements illustrated in FIG. 5A.

FIG. 5B illustrates the correlograms corresponding to the correlations of various pairs of the signals illustrated in FIG. 5A. For example, Correlogram 1-2 represents a function expressing with increasing amplitude, increasing similarity between the two signals, S1 and S2. This function is evaluated as the two signals are displaced relative to one another. As indicated on the displacement axis and consistent with the previously mentioned depth relationship, the displacement would be negative if the corresponding feature on the first signal was above the feature on the second signal. Similarly, the displacement would be zero if the feature occurred at equal depths and positive if the feature occurred at a deeper depth on the first signal than on the second. Thus, for the correlogram labeled 1–2 corresponding to the correlation of S1 with S2, the correspondence of Feature A with Feature B on Signals S1 and S2 respectively is more negative than the possible correspondence with Feature A' on S1 with Feature B.

As is illustrated with the S2 to S3 correlogram; i.e., Correlogram 2–3; where little ambiguity exists that Feature B corresponds to Feature C, a single peak indicated as B-C corresponds to the displacement. However, as indicated on each of the correlograms involving Signal 1, where two similar features, A and A' exist, there are two peaks which may more or less resemble each other, at least in amplitude, such that the displacements selected by detecting the maximum amplitude as the best correlogram likeness, might select either the A or A' feature as corresponding to the similar feature on the other signals.

If, as illustrated, for example, Feature A is the feature which actually corresponds to B, C and D on the other signals, then selecting displacement corresponding to A' would represent a miscorrelation. While it may be apparent to those skilled in this art that A is more similar than A' to Features B, C and D, such miscorrelations do in fact occur and, as is readily apparent from FIG. 5A, lead to displacements which, when combined with other displacements, define a plurality of additional planes.

With the techniques provided here, when two or more possibly corresponding features exist on one signal for a given feature on another signal, it is not required to select, perhaps incorrectly, only one displacement, but each possible displacement, particularly when the distinction is close, such as with A and A' in FIG. 5B, may be considered.

The exact nature and shape of the correlogram depends somewhat upon the correlation function selected. Therefore, the correlograms illustrated in FIG. 5B are not necessarily representative. FIGS. 6A through 6E illustrate in a simplified fashion a possibility for a miscorrelation which is considerably less dependent upon the nature of the correlation function and the shape of the resulting correlogram.

Figure 6B:
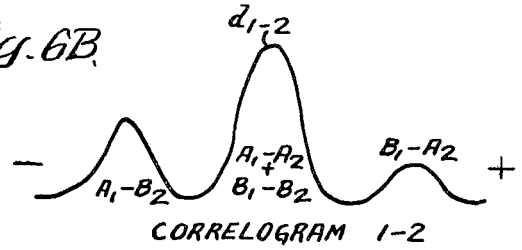
FIGS. 6B through 6G illustrate, in simplified form, six correlograms and the corresponding displacements usually selected in correlating various pairs of the four curves illustrated in FIG. 6A.
Figure 6C:
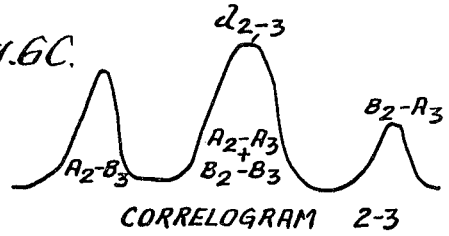
Figure 6A:
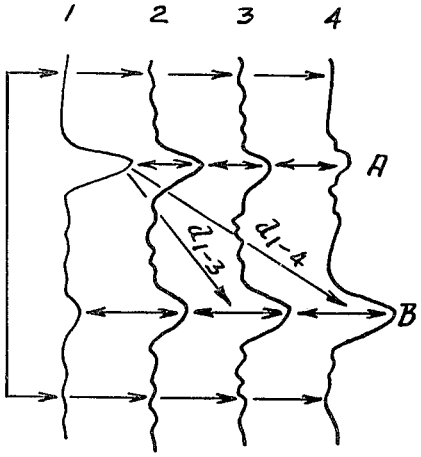
FIG. 6A illustrates additional possibly corresponding displacements between two similar characteristic features present on the signal curves in the same interval.

Referring now to FIG. 6A, there is shown the condition where two actual features, A and B, are present in the same correlation interval on Signals 1 through 4. However, in one sector of the hole, Feature A is better defined than Feature B, and in the other sector of the hole, the reverse is true. This variation in definition may be real, as for example, the sharpness of a bed boundary varies, or it may be artificially induced by a measurement problem such as the pad contact problem previously mentioned. For simplicity, both Features A and B are illustrated as intersecting the borehole at zero dip; i.e., no inclination relative to the borehole, so that no displacement occurs between the actual corresponding signal features.

Irrespective of the correlation function employed, and as will be appreciated when considering only two of the curves shown in FIG. 6A at a time, the presence of two similar features in the same interval has the distinct possibility of confusing the feature corresponding to A on one signal with the feature corresponding to B on another signal. This is particularly true when the actual corresponding signal feature is suppressed on one or both signals as may occur when these signals were obtained from substantially different sectors of the borehole. In the prior art practice, this may be further complicated by discarding what may be the correct correspondence, but, unfortunately, also the poorest quality correlation.

When correlating the Signal 1 with the Signal 2 shown in FIG. 6A, where there is little doubt that A corresponds to A on both signals, and when reinforced by even weak agreement in regard to Feature B, the correlation function produces a distinct peak as shown in FIG. 6B as Correlogram 1–2. Consequently, the displacement $d_{1-2}$ is accurately selected and corresponds to A with A and B with B on both signals. However, as illustrated in this correlogram, there is some evidence that A on Signal 1 could correspond with B on Signal 2 and somewhat less evidence that B on Signal 1 might correspond with A on Signal 2.

When correlating Signals 2 and 3, again the combined effect of A with A and B with B, as illustrated by Correlogram 2–3 in FIG. 6C, produces the correct displacement $d_{2-3}$, but now there is a distinct possibility that A on Signal 2 could be B on Signal 3, as indicated by the somewhat narrower but relatively large peak on the lefthand (−) side of Correlogram 2–3.

Figure 6D:
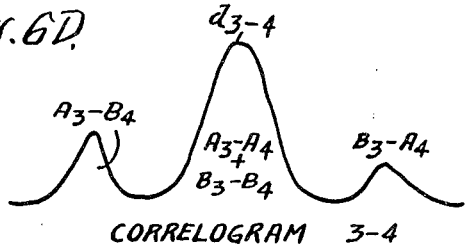

As illustrated in Correlogram 3–4 shown in FIG. 6D, the strong similarity of Feature B on both signals S3 and S4 along with some similarity for Feature A combine to produce a distinct peak on the correlogram at the correct displacement $d_{3-4}$. Since A on one signal does not resemble B on the other signal, the peaks corresponding to this conflict are not significant. In this case, the correlation function can be said to be dominated by Feature B, with little contribution from Feature A.

Figure 6E:
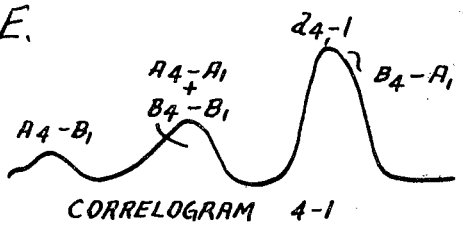

However, as illustrated in FIG. 6E, when correlating Signal 4 with Signal 1, there is the distinct possibility that Feature B on Signal 4 corresponds with Feature A on Signal 1. This is illustrated by the large peak designated as $B_4$-$A_1$ on the correlogram which results in the large positive displacement $d_{4-1}$. This erroneous displacement resulted from the suppression of Feature A on Signal 4 at the same time as Feature B was suppressed on Signal 1.

Figure 6F:
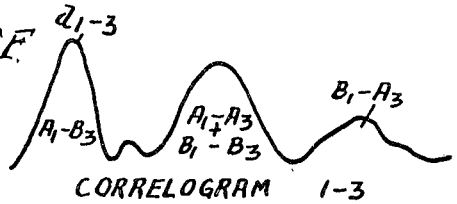
Figure 6G:
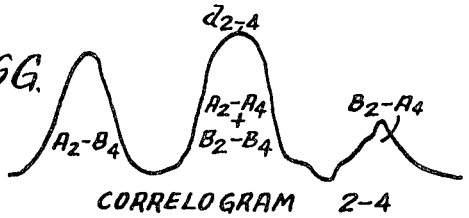

Similarly, in FIGS. 6F and 6G, where the correlations are across the borehole and the signals were derived from opposing pads, a substantial difference may exist in the actual characteristics of the signals. As illustrated in FIG. 6F, there is a strong resemblance between Feature A on Signal 1 and Feature B on Signal 3, resulting in a large negative-displacement peak on correlogram 1–3 and an incorrect displacement $d_{1-3}$ being determined. Of course, there is still a peak but of lesser amplitude corresponding to the combined effects of Features A and B on both signals which does indicate the correct displacement.

As illustrated in FIG. 6G, the correlation between Signal 2 and Signal 4 is also influenced by the strong resemblance of Feature A on Signal 2 with Feature B on Signal 4 because Feature A is suppressed on Signal 4. However, because Feature B is found on both Signals 2 and 4, the correct $d_{2-4}$ displacement is determined from the correlogram, but perhaps only marginally so.

Thus, FIGS. 6A through 6G illustrate how erroneous correlations may result for at least some of the correlations between pairs of signals obtained over the same interval, particularly where both signal intervals include two or more features. The problem is further complicated when conditions tend to change the nature of the signal features in different sectors of the borehole, such as may occur when formation bedding planes intersect the borehole at substantial angles. Here, the possibility exists that the two opposing pads measure the focussed response of the tool to a bedding plane intersecting the borehole at high inclination angles, while the other opposing pads measure the focused response with little inclination angle, resulting in substantial dis-similarities between adjacent signal pairs. These inclination angles may actually be produced by horizontal formations (of zero dip) which are penetrated by a highly deviated hole.

As previously mentioned, there are other types of correlation techniques from which displacements, displacement accuracy, and correlation quality determinations may be obtained, in addition to those employing correlograms. One useful technique can be characterized as pattern recognition and will be briefly reviewed here. In the pattern recognition technique, each signal is first decomposed or broken down into signal features or elements of various types, sizes, etc. For each such signal element, a network of characterizing parameters is computed which are representative of its form.

In the pattern recognition technique, a comparison is made between the similarity of possibly corresponding signal elements. Preferably, this correlation or comparison compares only signal elements of compatible types such as, for example, peaks with peaks. The correlation is made using the network of m characterizing parameters, P, by considering the difference between corresponding parameters for each of the two signal elements. A correlation factor CF may also be derived as follows:

$$CF=[P(1,S1)-P(1,S2)]^2+[P(2,S1)-P(2,S2)]^2+\cdots+[P(m,S1)-P(m,S2)]^2 \quad \text{(EQ. 3).}$$

P(m,S1) indicates the mth characteristic parameter in the network for signal S1, and similarly, P(m,S2) indicates the mth parameter for the signal element on Signal S2.

Of course, the position of the element on the signal is also determined, as for example, by a representative sample or sequence number for the depth of a characteristic sample of the element. One step in this pattern recognition technique includes computing the derivative or slope of the signal. The sample corresponding to extreme values of the slope may be used to characterize the position of such a signal element, and of course, is referenced when determining the displacement between two possibly corresponding elements.

It will be appreciated that the more extreme or sharper the slope of the elements involved, the more accurately this displacement accuracy e may be expressed as a function of this signal slope characterizing the position of the possibly corresponding elements. More particularly:

$$e=\frac{1.0}{(p+p')/2}; \quad \text{(Eq. 4)}$$

where p and p' are the slopes of the two signals on which the possibly corresponding signal elements are located at the samples characterizing the position of the elements.

It should be noted in any case, it may be necessary to take the precaution of preventing e from approaching zero, or some other precaution, which would prevent the line width, which it will be recalled, is a function of e, from approaching zero width.

As previously discussed in the case of multipeak correlograms or, as is more particularly the case where different peaks in correlograms corresponding to different intervals are selected to be the "best" likeness, several possible correspondents for a given signal element occur as well in the pattern recognition technique. For example, there may be two or more closely comparing signal elements on one signal, both of which possibly correspond to one signal element on another signal. This, of course, may be reflected in CF values which are nearly equal, and therefore, reflecting the uncertainty as to the true corresponding element. In the normal pattern recognition technique, as in most prior art techniques, a substantial effort, accompanied by some risk, is made to select only one correspondent. However, with the technique of the present invention, this final selection, and therefore the risk, need not be taken at this time. As with the correlogram technique several possible displacements may be considered; i.e., the displacements corresponding to each of the possibly corresponding signal elements. As before, when more than one possible displacement was determined from a given correlogram, the weight normally placed on a single possible signal element is distributed in accordance with the number of possible corresponding elements and the correlation factor or quality associated with each possibility. Therefore, the critical selection of only one possible displacement, while necessarily discarding all remaining possibilities, need not be made.

Thus, in general, independent of the type of correlation process employed to obtain displacements, each possible displacement may be considered in analysis. It becomes unnecessary to discard even multiple displacement possibilities where a unique displacement is uncertain, or displacements of doubtful accuracy or of lesser quality.

The prior art practice of discarding all but the minimum number of related displacements required for a given interval is, of course, heavily dependent upon the ability to consistently pick the required "best" displacements, which are usually taken as those corresponding to the best correlation factors. It will now be appreciated that because of the nature of the signals and the correlation process itself, the choice of the best displacement may in fact be quite arbitrary. By utilizing the techniques of the present invention which allows consideration of each displacement independently without the requirement for combination with other displacements for the purpose of analysis, the above problems are avoided.

With an understanding of how displacements, displacement accuracy and quality factors may be determined from different types of correlation procedures, the details of the processing of these displacements will now be provided. First, the nature of how each displacement is independently represented without regard to its displacement accuracy or quality, and second, how these accuracy and quality factors are utilized in a manner which actually enhances the dip determination, rather than prejudging and discarding the displacements as inferior without providing any chance for even the associated displacements to contribute their information to the process.

Two displacements connecting three points known to be on the same planar surface determine the dip and orientation of the surface. However, a single displacement between two points assumed to be on the same surface cannot define either the dip or the azimuth. Rather, only some limits as to the range for these values are provided. Additional displacements, not necessarily related to either of the two previous points, but on the same surface, may provide additional limits to the dip and azimuth values. By utilizing these and still additional displacements between independent points on not just one, but several surfaces corresponding to nearby formation features which are assumed to be planar and nearly parallel, the limits of the range of possible values is narrowed until an unique value is obtained. Unfortunately, formation features or surfaces are not exactly planar nor parallel, particularly over the small area seen from the borehole. Not one, but several different values may occur. A procedure is provided for determining the most representative value and therefore the more accurate value.

Referring now to FIG. 7A, there is shown how a single displacement between points A and B may be processed to best represent the possible dips corresponding to this displacement. To make these representations, it is preferred to utilize a plane P which is normal to the borehole axis and therefore the dipmeter tool at the depth of the displacement. This plane has the statistical property that errors in the dip representations are directly related to the errors in the displacement determination. Further, it has the computational advantage that corrections for deviation of the borehole axis from vertical may be delayed until the position corresponding to the formation dip is determined, so that only this position need be corrected to the normal geographic expressions of true dip and azimuth.

As shown in FIG. 7A, the representation of displacement $d_{A-B}$ in plane P may take the form of a line $R_1$–$R_2$. This line represents the intersection with plane P of all possible dip vectors corresponding to displacement $d_{A-B}$.

Referring back to FIG. 3, where the trace of a formation feature intersecting the borehole is shown, consider the displacement that would be obtained between pads 1 and 2 by correlating signals S1 and S2 and denoted there as $d_{1-2}$. This displacement corresponds to line A–B in FIG. 7A and is oriented in a plane parallel to the borehole or dipmeter tool axis and which includes the paths of electrodes number 1 and 2. Line R–R′ is drawn normal to this electrode plane at a position which is both normal to line A–B and which intersects the borehole axis z–z′ as shown in FIG. 7A. It will be seen that the line $R_1$–$R_2$ in plane P corresponds to line R–R′. Note that line $R_1$–$R_2$ may be characterized by distance l measured normal to the line from the line to the z–z′ axis, and the angle $\phi'$ between North and the line designated as l.

FIGS. 7B and 7C also illustrate the relationship between $d_{A-B}$ and the lines R–R′ and $R_1$–$R_2$. FIG. 7B shows lines A–B and R–R′ as viewed from above along the z–z′ axis. Since this view is looking down the borehole, two diameters $D_{1-3}$ and $D_{2-4}$ appear in true length. The line connecting points A and B does not appear in true length, but FIG. 7B does illustrate how angle $\phi'$ between North and line l can be determined. Recalling from FIG. 2 that the angle $\mu$ between magnetic North and electrode 1 is known and that the orientation of electrodes 1 and 2 are fixed relative to one another. It is therefore apparent that the angle between magnetic North and line l may also be readily determined, since line l is also parallel to the plane passing through electrodes 1 and 2 and normal to the borehole axis z–z′.

FIG. 7C shows the relationship between the length of line l and displacement $d_{A-B}$. In a view taken along line R–R′, both line A–B and the displacement appear in true length. The electrode distance; i.e., the distance between electrodes 1 and 2 in a plane normal to the borehole axis is shown as r and is related to the $D_{1-3}$ and $D_{2-4}$ diameter measurements by the relationships shown below FIG. 7C. Thus, line A–B, $d_{A-B}$, and line r form a right triangle. Since line r is parallel to the plane P, both being normal to the borehole axis z–z′ but located a distance H apart, it is readily apparent, from the similar triangles present, that sides r and H correspond as well as $d_{A-B}$ and l. The relationships between these sides corresponds to the tangent of the angle designated $\Delta$ and it becomes readily apparent that the length of line l is directly related to the displacement $d_{A-B}$. By equating the two ratios corresponding to tangent ($\Delta$), it is apparent that this relationship is:

$$l = \frac{Hd_{A-B}}{r} = Cd_{A-B}$$

where C is a scale factor or constant, when r and H are constant as, for example, in uniform borehole sizes or when the ratio H/r is made constant to compensate for variations in borehole diameters $D_{1-3}$ and $D_{2-4}$.

FIGS. 7A and 7B readily illustrate how the angle $\phi'$ may be determined from the orientation of the two electrodes providing the two signals between which this displacement was determined, and the length of the line l may be determined from the displacement.

It is also apparent from FIG. 7A that with l and $\phi'$ known, $R_1$ and $R_2$ in plane P may be drawn to represent the displacement, and, as will be further appreciated, the intersection of all the possible dip vectors corresponding to this displacement with the plane P.

In addition to the above method of determining line $R_1$–$R_2$ in plane P to represent possible dips corresponding to a displacement, an additional method may be used which particularly lends itself to varying the width of this line.

Refer now to FIG. 8, where in addition to line $R_{1-R2}$, there is a second line $R_3$–$R_4$. Both these lines are parallel and serve as borders for the actual line contained therebetween. Of course, it is possible to determine both of these lines, using the methods illustrated in FIGS. 7A through 7C, simply by determining the corresponding line lengths l for each line. However, the method illustrated in FIG. 8 is more compatible with the usual methods of computing dip vectors by supplying two adjacent displacements to a standardized procedure which results in the components of a dip vector corresponding to the displacement combination. This vector is projected normal to the dip plane and upwards therefrom.

When such procedures are available, it is convenient to apply an artificial second displacement to provide the required two displacements needed to define the vector. For example, a standardized but somewhat arbitrary displacement may be provided between point A on Signal 1 and point M on Signal 3. This displacement may be a constant value, perhaps corresponding to three feet. Therefore, providing the standard dip vector computation procedure with displacements $d_{A-B}$ and $d_{A-M}$, along with the orientation of electrodes 1, 2 and 3 corresponding to A, B and M respectively, the procedure would provide an apparent dip vector corresponding to A-B-M. This vector is designated as $V_o$ in FIG. 8 and intersects plane P at $R_o$.

In a similar manner, a corresponding vector could be computed corresponding to plane A-B-N substituting the dummy displacement $d_{A-N}$ as the second displacement to the standardized routine. Note that neither this plane or vector is shown in FIG. 8. Normally, the substitute displacement is taken on the same signal equidistant above and below point A; i.e., $d_{A-M}=-d_{A-N}$.

As is apparent in FIG. 8, four vectors, $V_1$ through $V_4$ may be computed to determine two points on each of lines $R_1$–$R_2$ and $R_3$–$R_4$; the distance between these two lines actually corresponding to a line width. It will now be explained how this line width is varied in accordance with a displacement determination error e. Referring to FIG. 8, noting on the line corresponding to the path traced by electrode 2 on the borehole surface, there is shown points E and F located a distance e′ and e respectively above and below point B. It is apparent that point E corresponds to $d_{A-B}-e'$ while point F corresponds to $d_{A-B}+e$. Therefore, the points between E and F define the range for possible displacement errors corresponding to the displacement between points A and B. Now, there are four planes present which are, from top to bottom, A-E-M, A-F-M, A-E-N, and A-F-N. These four planes determine four vectors and the four points in plane P according to the following table:

| DISPLACEMENTS | VECTOR | POINT IN PLANE P |
|---|---|---|
| $d_{A-B}-e'$, $d_{A-M}$ | $V_1$ | $R_1$ |
| $d_{A-B}-e'$, $d_{A-N}$ | $V_2$ | $R_2$ |
| $d_{A-B}+e$, $d_{A-M}$ | $V_3$ | $R_3$ |
| $d_{A-B}+e$, $d_{A-N}$ | $V_4$ | $R_4$. |

It is now apparent that the distance between lines intersecting point pairs $R_1$–$R_2$ and $R_3$–$R_4$; i.e., the line width is directly related to the displacement error e.

Figure 9:
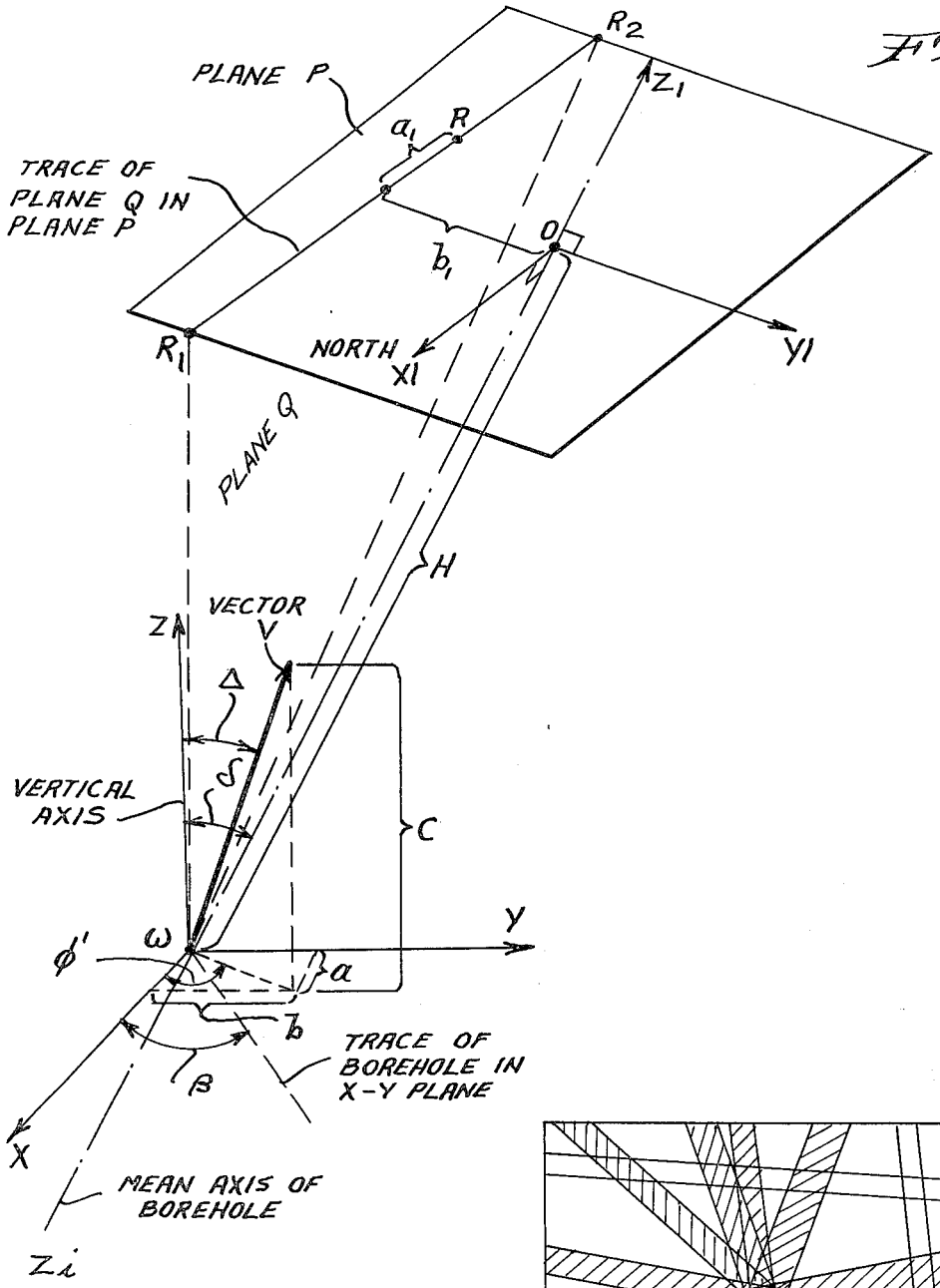
FIG. 9 illustrates certain relationships useful in translating vector components between the Plane P normal to the mean borehole axis and a horizontal Plane X-Y when deviated boreholes incline Plane P from the horizontal plane.

Plane P is horizontal only when the borehole is vertical. When the borehole is deviated from vertical, an angle δ corresponding to the deviation angle of the borehole from vertical may be measured as indicated in FIG. 2. FIG. 9 illustrates the consideration that may be made for translating components of vectors in such cases. Note that Plane P still remains normal to the mean borehole axis which is illustrated in FIG. 9 as $z_1$–$z_i$, which is different from the vertical z axis denoted there as Z. Two X-Y coordinate systems are shown, both referenced to the direction North. The X-Y coordinate system in the horizontal plane is denoted as X-Y while that in the Plane P normal to the borehole is denoted $x_1$–$y_1$. In both cases, North corresponds to the X axis. If a vector V located in Plane Q has X-Y-Z components of a, b and c as shown in FIG. 9, the components of its intersection point R in Plane P; i.e., $a_1$ and $b_1$, corresponding respectively to the $x_1$ and $y_1$ coordinates, may also be calculated. For example, if:

$$a = \sin(\Delta)\cos(\phi')$$
$$b = \sin(\Delta)\sin(\phi')$$
$$c = \cos(\Delta)$$

where Δ is the angle between the vector and the Z axis and φ′ is the angle between North or the X axis and the vector projected on the X-Y plane; then, the $x_1$ and $y_1$ components of the vector intersection point R in Plane P normal to the mean axis of the borehole and located the distance H along this axis from the X-Y plane become:

$$x_1 = \frac{a}{A}(\cos^2(\beta)\cos^2(\delta)\sin^2(\beta))$$

-continued $$+ \frac{b}{A}(\sin(\beta)\cos(\beta)\sin^2(\delta))$$
$$+ \frac{c}{A}(\sin(\delta)\cos(\delta)\cos(\beta)): \text{ and}$$
$$y_1 = \frac{b}{A}\cos(\delta) - \frac{c}{A}\sin(\beta)\sin(\delta) \text{ where:}$$
$$A = \sqrt{\sin^2(\beta) + \cos^2(\beta)\cos^2(\delta)} \times L/H;$$
$$L = (-a\sin(\delta)\cos(\beta) + b\sin(\delta)\sin(\beta) + c\cos(\delta)).$$

Thus, it is apparent from the above that one may translate the components of a vector or the coordinates of a point from one plane to another.

The equations corresponding to one border of the line in Plane P using the projection system depicted in FIGS. 7A through 7C may be expressed directly in terms of single displacements corresponding to each border. For example, for displacement $d_{A-B}-e'$, the equation becomes:

$$d_{A-B}-e' = x\cos(\phi')+y\sin(\phi')$$

and for displacement $$d_{A-B}+e;$$

$$d_{A-B}+e = x\cos(\phi')+y\sin(\phi'),$$

which of course, are parallel.

Figure 10:
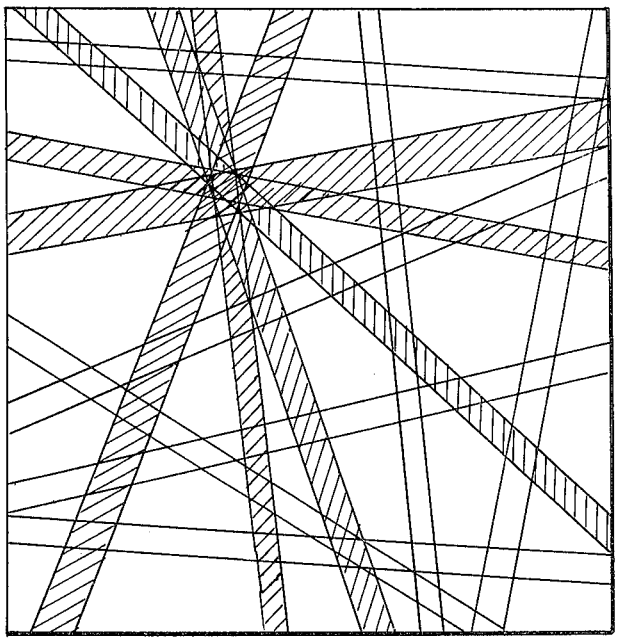
FIG. 10 illustrates the representation of several displacements which vary in displacement accuracy (line width), quality (line weight or intensity) and orientation (direction of line).

Thus, a number of ways of deriving the position of a line or the borders of a line of a given width corresponding to the displacement error e in the Plane P normal to the borehole axis are available. Thus, for each displacement, a line of given width may be placed in Plane P to represent all possible dips corresponding to that displacement. The larger the displacement the longer the line l will be between the line representation and the origin O corresponding to the intersection of the mean borehole axis z–z′ with Plane P. The orientation of the line depends also upon the orientation of the signal sources from which the displacements were derived. When a number of these displacements have been so represented, the lines represented in Plane P might appear as shown in FIG. 10. Note that the lines vary in orientation, distance from the center of the plane, line width and line intensity or weight as indicated by the crosshatching within the borders of some lines. As shown in FIG. 10, there may be many intersections between these lines. However, the correct dip will be indicated by the predominant coincidence of intersections and, more particularly, by the intersections of the narrower and more intense lines. Of course, it will now be appreciated that once this position is known, it is a relatively simple and straightforward task to convert this position through the trigonometric relationships depicted in FIGS. 7A through FIG. 9 into the corresponding formation dip and aximuth values.

Figure 11A:
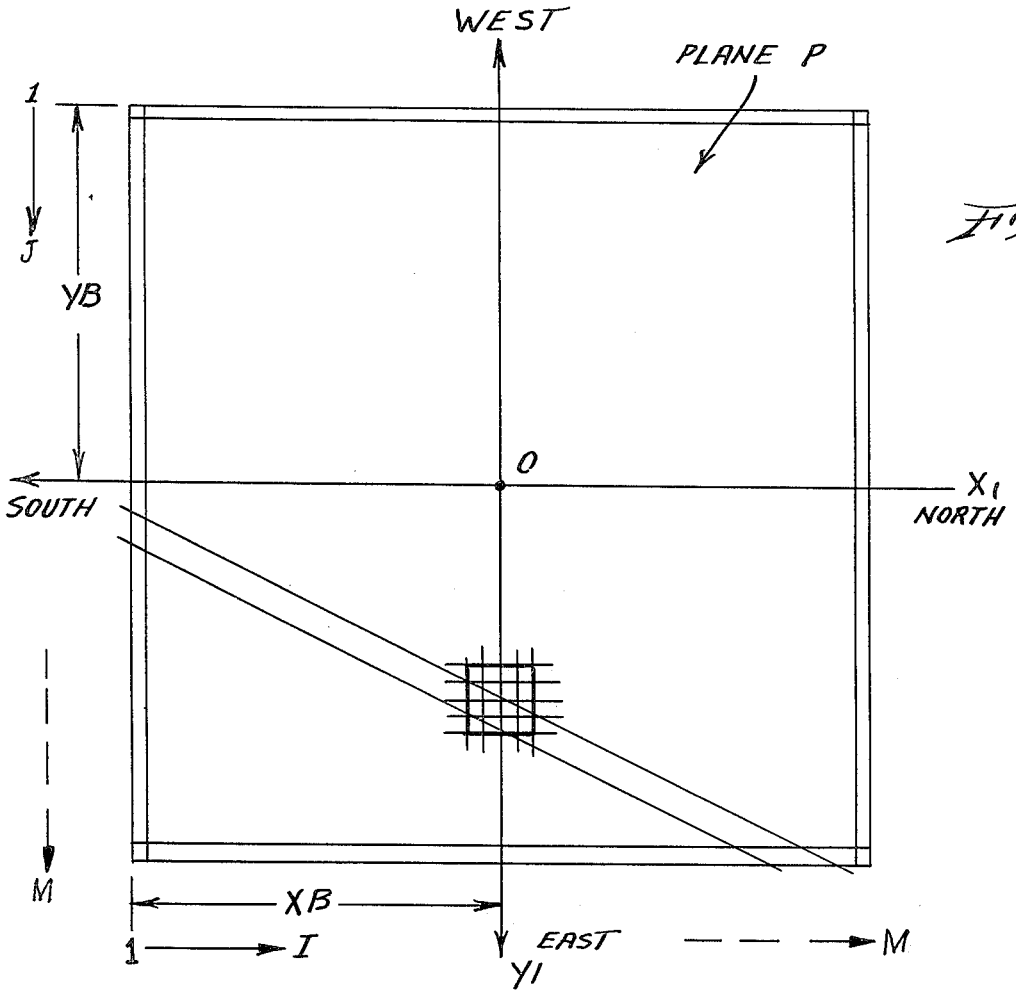
FIG. 11A illustrates the Plane P when represented as an array of individual counters oriented to the $X_1$-$Y_1$ axis, each counter or cell having a unique address which may, in one form, be considered as indices I and J.
Figure 11B:
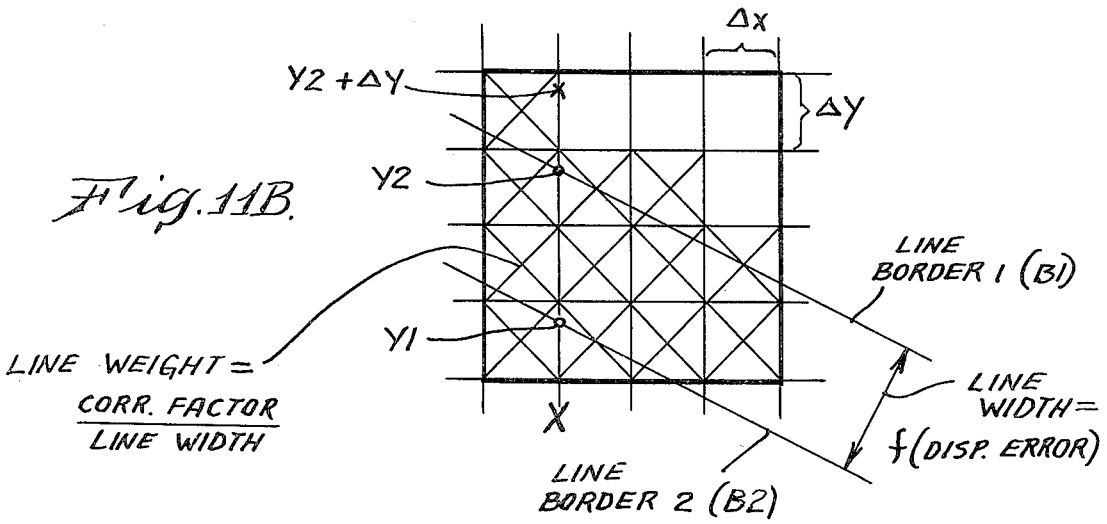
FIG. 11B shows a section of FIG. 11A and how a line defined by two line borders B1 and B2 is regarded in relation to the cells it touches in the array of cells.

Referring now to FIGS. 11A and 11B, there is shown how plane P may be divided into an array of individual counters or cells, each having an unique address which may be expressed as a function of its position in the plane. This position is referenced to the x-y coordinate axis previously discussed and shown in FIGS. 7A through FIG. 9. An additional reference system corresponding to I and J indices may also be used to directly reference each cell in the plane as "CELL" (I,J).

It is convenient to use a plane symmetrically placed about the x-y axes and extending a distance XB and YB therefrom, respectively. Each edge of the plane is divided into M divisions, each x and y division corresponding to $\Delta X$ and $\Delta Y$. Normally $\Delta X = \Delta Y = 2XB/M$ and is adjusted in accordance with the dip resolution required. For example, if a one-degree dip resolution is desired in a ten-inch diameter borehole, $\Delta X$ should correspond to a displacement of about 0.1 inches between adjacent signals: e.g., $d_{1-2}$; and 0.175 inches for diagonal displacements; e.g., $d_{1-3}$.

Referring now to FIG. 11B, there is shown an enlarged section of FIG. 11A illustrating a line defined between borders B1 and B2, one border corresponding to the displacement plus the displacement error e, the other to the displacement minus e, and therefore, the line width is a function of the displacement error e.

The cells or counters corresponding to Plane P are used to accumulate the line weight in each cell touched by the line. Thus, if the line shown in FIG. 11B has a weight LW, this weight is added to the previous contents of each cell or counter designated by the crossed lines in the cell shown in FIG. 11B. LW is, as previously discussed, directly related to the quality QAL of the correlation which determined the represented displacement and inversely related to the displacement error e and therefore the line width. With the mechanics of positioning in the Plane P a line which represents possible dips corresponding to a given displacement understood, and further, how the width and weight of this line may be varied in accordance with displacement accuracy and correlation factor quality associated with this displacement, and still further how the Plane P may be divided into counters or cells for accumulating the coincidence of a line with the cell and therefore the coincidence of many lins of varying weights with a given cell, it will be appreciated that it is a straightforward procedure to analyze the contents of these cells after having so processed a large number of displacements to determine the cell corresponding to the highest coincidence of lines or more particularly, to the largest accumulation of line weights. If this accumulated weight can be significantly distinguished between the weights of other cells, as for example, average weight of all the cells, the position of this cell may be relied upon as corresponding to the actual formation dip. The conversion of this position to the usual expressions of true dip and azimuth may then be made utilizing the relations illustrated in FIGS. 7A through 9.

Figure 12C:
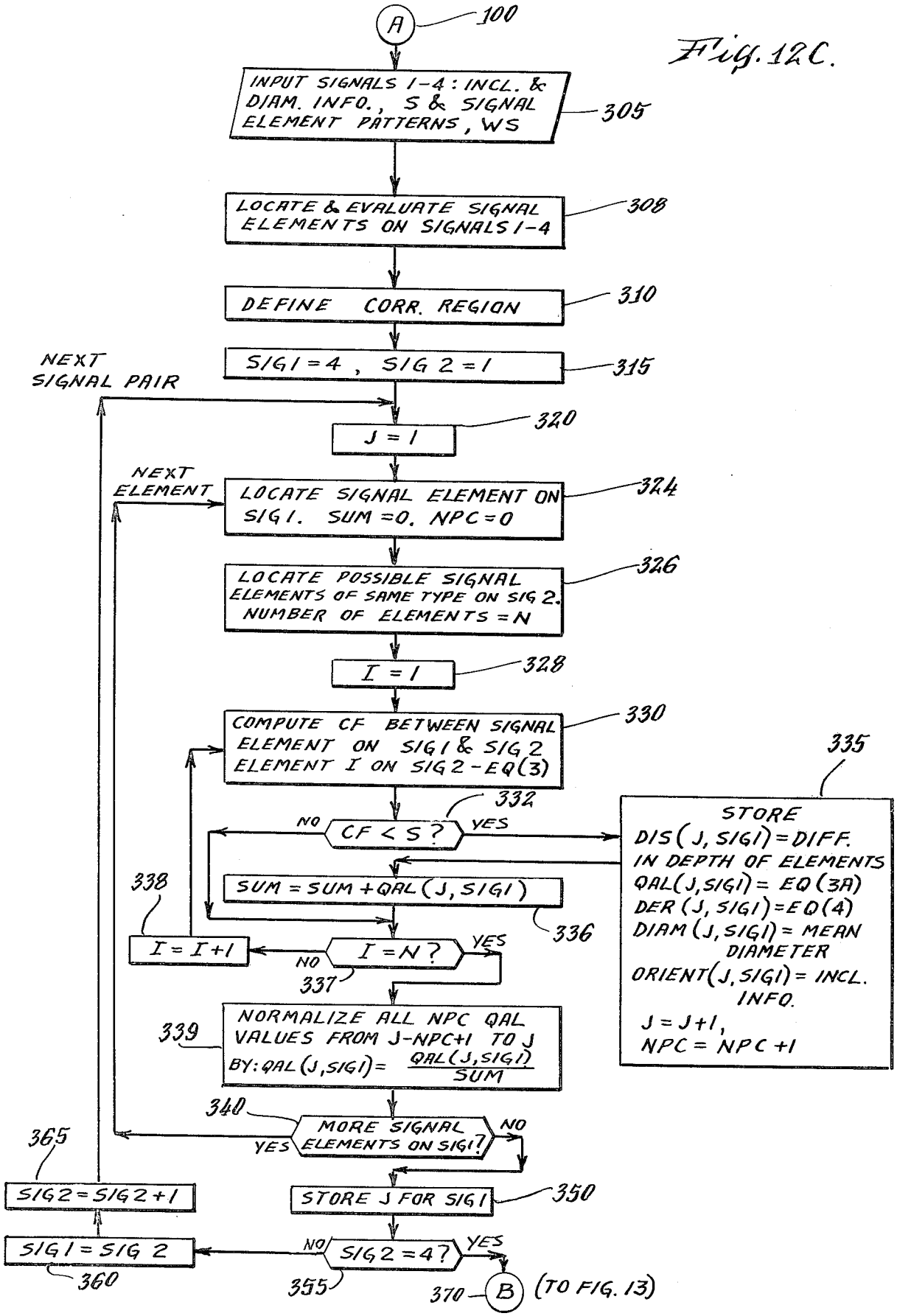
FIG. 12C illustrates how the input of FIG. 12A may be produced using a pattern recognition type of correlation technique.
Figure 13:
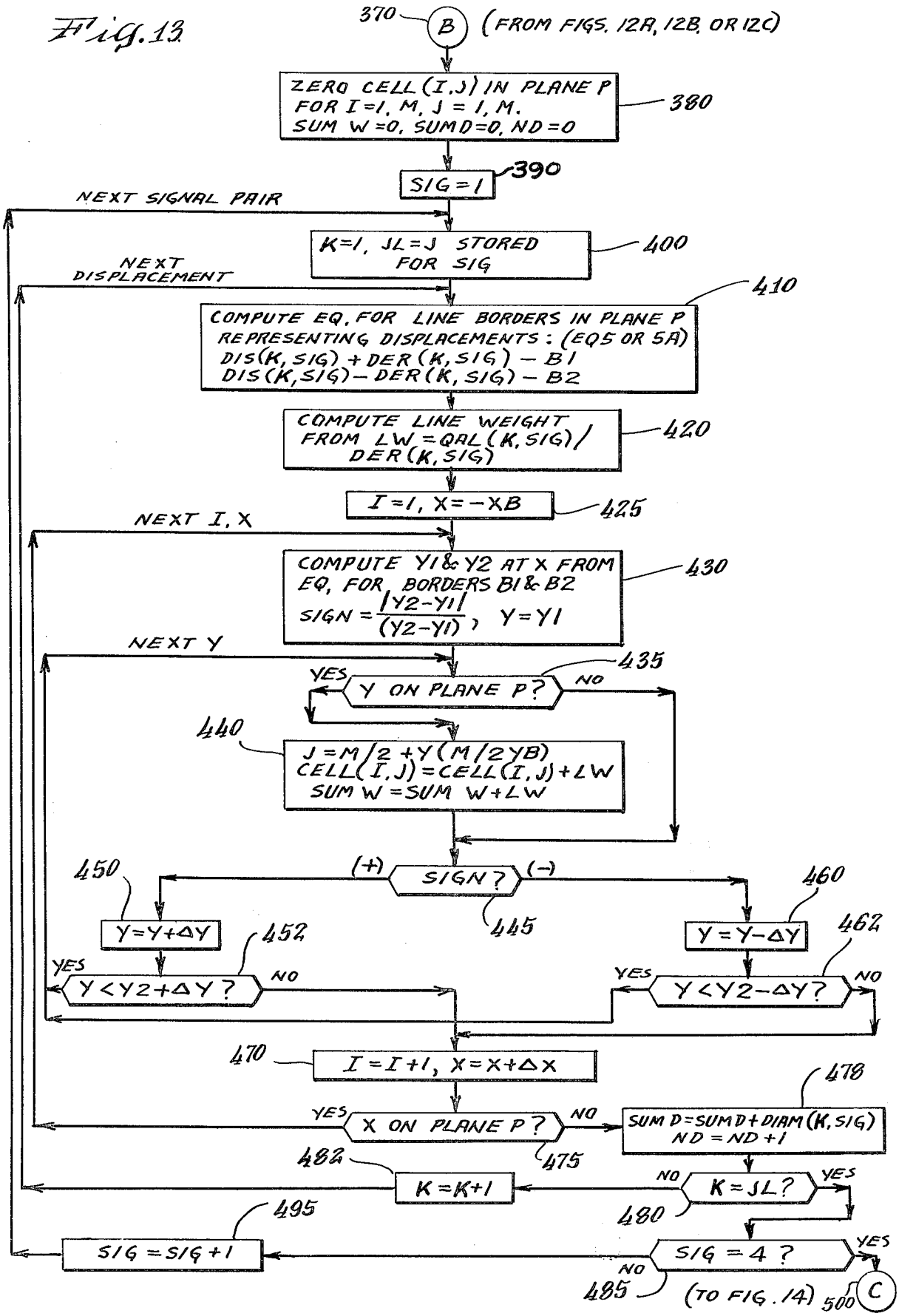
FIGS. 13 and 14 illustrate a procedure illustrative of the steps of one form of the displacement processing technique.
Figure 14:
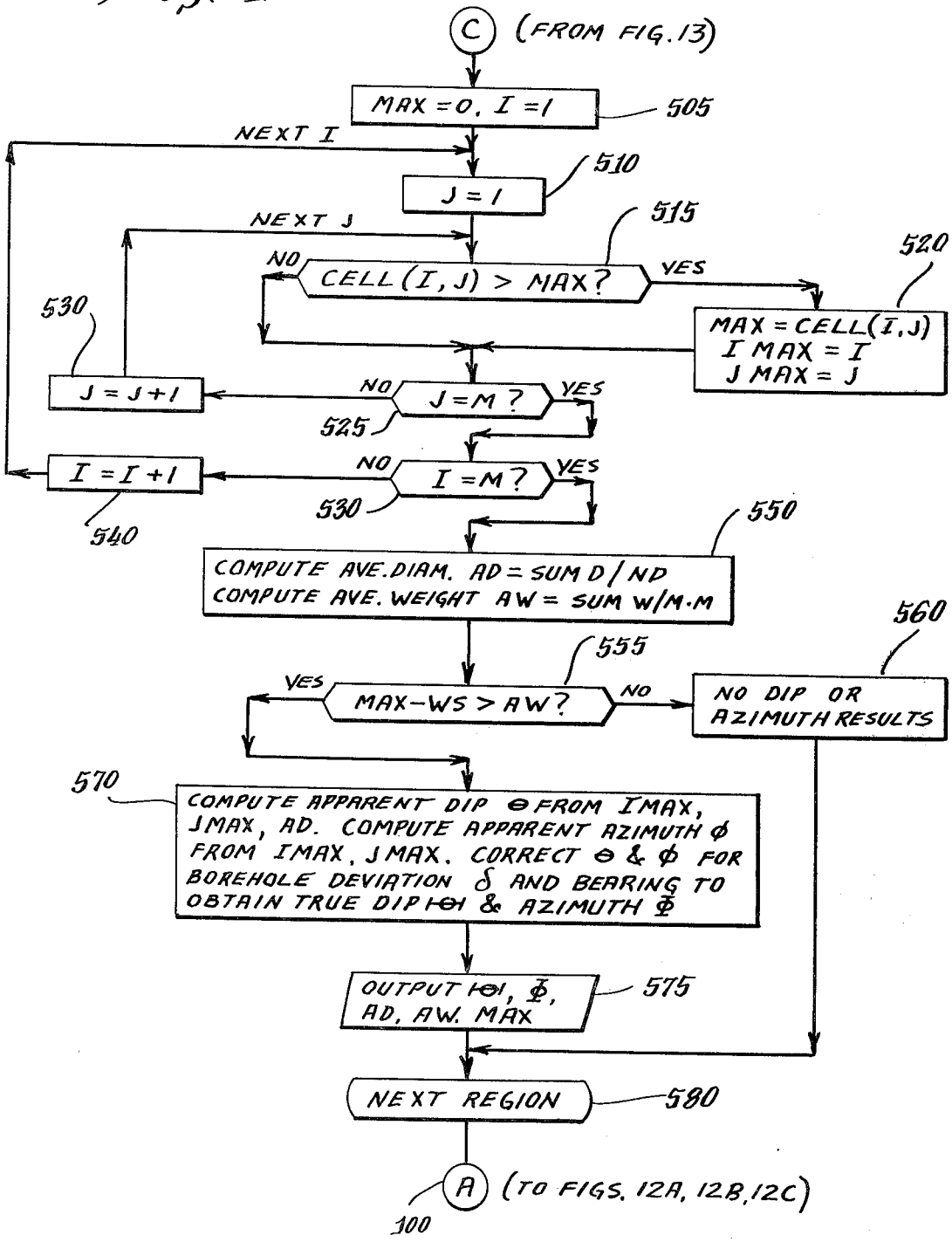

The preferred method of implementing the above-described process is through the utilization of a computer program, the detailed steps of which are shown in FIGS. 13 and 14. FIGS. 12A, 12B and 12C describe some alternative preliminary steps which may be required, depending upon the source of the displacement to be processed. The preferred apparatus is a general purpose digital computer properly programmed to execute these illustrated steps and perform the accompanying described process which will now follow. However, small scale computers located at the well site such as computer 60 shown in FIG. 1 may also be used as well as special purpose digital or analog devices, each dedicated to perform a particular part of the process.

Referring now to FIGS. 12A, 12B and 12C, there are shown alternate preliminary steps illustrative of providing essential as well as optional input to the displacement processing procedures which follow and begin with FIG. 13 and conclude with FIG. 14. As previously discussed, a technique is provided for processing displacements, the general nature of which is independent of the procedure used to obtain these displacements. Details of two types of correlation techniques have already been discussed. FIG. 12A provides a possible use for additional correlation techniques which have not yet been described. FIG. 12B is included as a review of the steps of the correlation technique employing a correlogram while FIG. 12C, the correlation technique referred to herein as pattern recognition. The minimum requirement for each of these techniques is that a series of displacements between at least one pair of signals, along with the orientation of the signals corresponding to these displacements be obtained for at least two regions or intervals. The displacements are designated as DIS(J,SIG) while the orientation is designated as ORIENT(J,SIG). J is used to designate one displacement number in the series while SIG denotes the particular signal pair.

Optional input includes the quality factor associated with the displacement determination, here designated QAL(J,SIG) which will be recalled may be used to vary the intensity or weight of the displacement representation. Also optional is the displacement accuracy or error range, previously designated as e and here designated for computer programming compatibility as DER(J,SIG) which may be used to vary the line width of the displacement representation. For the sake of completeness and to provide for the possibility of varying borehole diameters, the diameter or some function representative of the electrode distance r at the depth level corresponding to the displacement is optionally included. Here the designation DIAM(J,SIG) is illustrated.

Referring now to FIG. 12A, beginning at Point A designated as 100, the alternative process corresponding to inputting and standardizing the essential and optional inputs begins. As shown in the first input step, Block 110, the information necessary to define a region of interest, along with a parameter designated as WS is initially input. This latter parameter is utilized as shown in Block 555 of FIG. 14 as will be explained later. The definition of a region or interval of interest normally corresponds to the range of depths, sequence numbers, or other displacement identifications which may be applied to delineate a particular geologic unit or interval which may be expected to contain several formation features or surfaces representative of structural dip. Such information is normally determined by examination of well logs, drilling information, or provided by local geologic knowledge.

The next step in the proces may be as shown in Block 120 of FIG. 12A where the counter J is initialized, here for example, to the value 1. Subsequently, as shown in Block 130, the input of the first of a series of already obtained information may be read, for example, for magnetic tape storage output from previous dipmeter computation programs or provided on punched cards or other input media, perhaps even from manual correlation techniques. As illustrated, for each available signal pair, the displacement DIS, its orientation and its depth, along with associated quality and displacement error values, if available, may be input at this time.

Then, as shown in Block 134, a test is made to see if the above input corresponds to any part of the region defined as shown in Block 110. If this is the case, the process continues as shown in Block 135 to store for later use the previously mentioned standardized values. As shown in Block 135 of FIG. 12A, the displacement DIS, its quality QUAL, displacement error DER, diameter DIAM, and orientation ORIENT, are all stored for displacement J on the signal pair designated as SIG.

Note that the identification of the second signals in the signal pair is not essential since it is not required that particular combinations of displacements from certain related signal pairs be present or identified. The identity of the signal pair may facilitate, however, the determination of the orientation of the displacement, since the direction from magnetic North is normally referenced to one identified electrode; e.g., electrode No. 1, for example. Similarly, identification of a signal pair may facilitate the determination of the electrode distance r, as for example; i.e., to identify whether the displacement was associated with adjacent electrodes or diagonal electrodes. Finally, as shown in Block 135, the displacement counter J is incremented to provide for additional displacements in the series.

The process then returns to the test indicated in Block 140 to see if this input corresponds to the end of the region defined in Block 110. Initially, since more than one displacement from two different depths would be required in this case, this test would answer NO and the process would continue again at Block 130 for additional input, which, if it was within the region, would be stored as described above.

However, if the end of the region had been reached, the test indicated in Block 140 would answer YES and this preliminary process would conclude by storing, as indicated at Block 150, the final value of J corresponding to the number of displacements in the region and present for further processing. This processing is shown as beginning at Point B and continuing in FIG. 13.

Note that several signal pairs may be involved at each depth and many displacements may be obtained between various combinations of these signals. In such cases, the above described process would be performed for as many such signal combinations as desired and the number J of displacements between each signal pair which are included in the interval would similarly be stored.

Referring now to FIG. 12B, there is illustrated the preliminary process which might be used in the case that no displacements had previously been determined. Beginning again at Point A and using the four-pad dipmeter illustrated in FIG. 1 as an example, the input would consist of Signals 1 through 4, inclinometer and diameter information, a parameter indicated as MQ corresponding to the minimum quality factor acceptable for the correlation function to have any meaning at all, the correlation step and the correlation interval, along with WS which has been previously described in regard to Block 110 of FIG. 12A.

The correlation step and correlation interval are well known as parameters associated with customary correlation procedures used to produce the correlogram. In review, the correlation interval is the number of samples from each signal considered in each of the series of correlation factors comprising the correlogram. The correlation step is the number of samples usually measured on a reference signal between each movement of the correlation interval; i.e., between each correlogram.

Next, as shown in Block 210, the region or interval of interest as described in regard to Block 110 of FIG. 12A is again defined, but now it is expressed in terms of the number of correlation intervals needed to cover the region of interest. This, of course, is a function of the correlation step. For example, if the region is in the order of twenty feet and the correlation step is in the order of two feet, then at least ten intervals would be needed to correlate the corresponding signals.

Block 215 of FIG. 12B indicates the initializing step which may be used to begin correlating the four signals input in Block 205. For simplicity, only four combinations, corresponding to adjacent pairs, of these signals will be illustrated. With the four-pad tool, two adddditional displacements corresponding to the diagonal signal pairs may also be determined. Initially, two signals are designated and indicated here as SIG1 and SIG2, which are initially assigned to Signals 4 and 1, respectively. Then, as shown in Block 220, additional indicators, I and J are both set to one. I will be used to count the number of intervals correlated within the region and J, the number of displacements as before.

Block 225 of FIG. 12B corresponds to the process of correlating the signal designated as SIG1 with the signal designated as SIG2 for the particular correlation interval indicated by I to obtain a series of correlation factors CF versus the displacement between the correlation intervals on each of the signal pairs; i.e., to obtain the correlogram previously discussed. A correlation function which may be employed is that of Equation 1, with SIG1 corresponding to S and SIG2 corresponding to S'. Then, as previously described in regard to the use of correlograms such as shown in FIG. 4 and discussed in regard thereto, Block 230 of FIG. 12B corresponds to examining the correlogram obtained and determining the best correlation factor in the correlogram, such as that shown as Q in FIG. 4 where the best likeness corresponds to the peak. This best CF is now regarded as the quality factor and may be further tested as indicated in Block 232 to determine if it meets at least minimum quality standards.

As mentioned in regard to Equation 1, this correlation function provides a normalized correlogram such that the quality of the correlation may be rated on a scale as, for example, from −100 to +100, the latter corresponding to a perfect likeness. In such a case MQ would preferably be a value of about 50 since correlation factors below this value probably represent mere noise, and only CF or quality factors greater than MQ are meaningful. In this case, the test indicated in Block 232 answers YES and the process continues as shown to Block 235 to store the input previously discussed in regard to Block 135. The displacement may later be identified by using the first or the base signal in the correlation process, here SIG1, and as before, by the current value of the displacement indicator.

As previously mentioned in regard to using correlograms, the displacement corresponds to the point on the correlogram considered the best correlation factor, and as shown in FIG. 4, is a peak. It will be appreciated that with some correlation functions, it could correspond to a minimum value on the correlogram. In this latter case, an appropriate scaling of the best CF or quality factor should be performed.

As previously mentioned, in regard to FIG. 4 and particularly in regard to Equation 2, two displacement errors e and e', corresponding to a certain percentage change in the correlogram amplitude or CF may be employed as a displacement error value or accuracy function. These may be averaged in accordance with Equation 2, and now stored as indicated in Block 235 as DER.

Another optional value is DIAM which is illustrated here as the mean diameter. Also illustrated is the orientation of the displacement which is assigned the same identification as the displacement and may be obtained as described in regard to FIG. 7B, corresponding to the angle designated there as $\phi'$. This, of course, may be obtained from the inclinometer information. Finally, as shown in Block 235, the indicator J is incremented in anticipation of the next displacement.

The process returns to the test indicated in Block 240 to see if I corresponds to the number of intervals required to cover the defined region. Of course, in the initial correlation, the test would answer NO and the process continue as shown in Block 245 to increment I to the next interval, which would then be correlated as previously discussed in regard to Block 225. If, however, the number of required intervals have been correlated, the test indicated in Block 240 would answer YES, and as shown then in Block 250, the number of displacements J associated with SIG1 would be stored.

Since several signal combinations are possible, the test shown in Block 255 is illustrative of testing for the last combination which would occur in the illustrated case when SIG2=4. Recall that only one signal pair may actually be required, but for the illustrated case which obtains four displacements between the four adjacent signals, this test would answer NO initially, whereupon the SIG1 indicator would be updated with the SIG2 signal designation, as shown in Block 260 and then the SIG2 indication increased by 1 as shown in Block 265. Thus, a new signal pair is identified and the process continues again at Block 220, resetting the I and J indicators, to begin correlating I intervals of this signal combination.

It is not necessarily true that I displacements will be determined, however. As, for example, if the test indicated in Block 232 answers No, indicating a meaningless correlation function has been found, the process shown in Block 235 will be bypassed since the test answers NO, and the procedure would continue directly with that indicated in Block 240.

The above described processes are repeated for each desired signal combination and, as illustrated, could result in several displacements for each signal combination, such as those designated as 1 through 4 in FIG. 3, but here determined in the order of $d_{4-1}$, $d_{1-2}$, etc., through $d_{3-4}$, whereupon SIG2=4, and the test indicated in Block 255 would answer YES, completing this preliminary process at Point B which is designated at 370 and continues in FIG. 13.

While FIG. 12B illustrates the preliminary steps of obtaining displacements using the correlogram technique, FIG. 12C illustrates the corresponding steps for the pattern recognition technique. Again beginning at Point B and as shown at Block 305, Signals 1 through 4, inclinometer and diameter information, along with WS which has been previously discussed, are input. However, some additional information may be desired in the pattern recognition technique. These are S, a threshold used in this technique and the definition of the signal elements; i.e., the patterns, such as peaks, bumps, depressions, etc., which may be used to characterize specific signal features.

The pattern recognition technique, as shown in the next Block 308, initially processes each signal independently and locates and evaluates the various signal element types. The location usually corresponds to the position of the characterizing sample; i.e., the sample corresponding to a peak, inflection point, initial or final boundary of the signal element. The evaluation consists of computing a network of characterizing parameters, the nature of which varies with the type of signal element, and which have been previously discussed in regard to Equation 3. This location and evaluation process is repeated for each of the signals, 1 through 4, resulting in tables of elements and their characterizing parameters for each of the signals.

Normally, the above process would be followed by a series of correlation and boundary adjustment considerations. However, in the use of the pattern recognition technique to provide input to the present displacement processing technique, the boundary adjustment steps are preferably unnecessary, since they restrict the number of possible corresponding elements and therefore may prevent considering all possible correspondents for a particular signal element. Since the technique of this invention allows consideration of all of these possible correspondents within the region, the restrictive boundary adjustment procedure is preferably omitted to receive maximum advantage of this feature.

Next, as shown in Block 310 of FIG. 12C and previously discussed in regard to corresponding Blocks 110 and 210 of FIGS. 12A and 12B, the region desired to be correlated is defined, in this case, in terms of the positions of the first and last signal element considered to be within the region. Then, as shown in Block 315, the initial pair of signals to be correlated is defined as was discussed in regard to Block 215 of FIG. 12B. As next shown in Block 320, the indicator J may be initialized.

Initially, as indicated in Block 324, the first signal element within the region on SIG1 is located. Also indicated in Block 324 are the initialization of two accumulators designated here as SUM and NPC, to 0. These accumulators are used to sum and count the number of possible correspondents of a given signal element on SIG1 and therefore to normalize the contribution or weight accordingly. This normalization considers that a single correspondent should carry more weight than a number of possible correspondents, since the more possible correspondents there are for a given correspondent, the less is the certainty of any of these possible correspondents. The details of the normalization process will be described further in regard to Blocks 336 and 339.

Initially, as indicated in Block 326, all the possible corresponding signal elements are located on SIG2 which are preferably of the same type of signal element as that located, as indicated in Block 324, on SIG1. These are also counted, the number of such elements being here designated as N. Since each element on SIG1 may have several possible corresponding elements on SIG2, each will be considered. However, the weight given each consideration will be normalized as previously mentioned in regard to Block 324 to consider this number of possibilities. This number is not necessarily N, as will be explained below. The actual number of corresponding elements will be counted by the indicator I which may be initialized now as shown in Block 328.

The actual consideration includes the computation of a correlation factor CF as shown in Block 330 and which compares the similarity of a signal element on SIG1 with the Ith possibly corresponding signal element on SIG2; i.e., in the initial case, the first possibly corresponding element. Here, as indicated, the previously discussed Equation 3 may be used to determine the correlation factor CF. It will be recalled that this equation utilizes the network of characteristic parameters and compares like parameters for the two considered signal elements to obtain CF.

CF is then compared as shown in Block 332 to the threshold value S input as shown in Block 305. This threshold is used like MQ shown in FIG. 12B to discriminate against meaningless correlation factors, but which, in this case, are those which exceed the threshold level S. This results in the test indicated in Block 332 answering No, and the bypassing of the processes indicated in Blocks 335 and 336.

However, when a reliable correlation factor is obtained; i.e., where CF is less than S, the test indicated in Block 332 will answer YES and the previously discussed parameters shown in Block 335 will be derived and stored. Here, the displacement now corresponds to the difference in depth between the signal element on SIG1 and the latest considered possibly corresponding signal element on SIG2.

The quality factor corresponding to this displacement, however, must be now provisionally assigned, since it is not known at this time how many of the N possibly corresponding elements will actually be considered as reasonable correspondents by answering YES to the test indicated in Block 332. Further, it is desired to adjust the quality factors associated with the pattern recognition correlation technique to compare with those obtained by other correlation techniques, although this may not be actually necessary when all the displacements and corresponding qualities are obtained from the same type of correlation technique. However, it is desired that no possibility exists for the line weight which, it will be recalled, is a function of this quality, be allowed to approach zero.

Accordingly, the correlation factor CF derived in a pattern recognition technique may be adjusted by the following equation:

$$QAL = 100\ \frac{S - CF}{S} \qquad \text{(EQ. 3A)}$$

where S is the threshold value previously input and discussed in regard to Block 305 of FIG. 12C. Since CF is always smaller than S as determined by the test in Block 332, and the best values of CF approach zero, it can be seen that the range for QAL varies between zero and 100 with 100 corresponding to the best quality correlations.

The pattern recognition technique also requires some special consideration in regard to the displacement error determination which was previously discussed in regard to Equation 4. Here, of course, e corresponds to DER which increases with increasing inaccuracies in the position of the considered signal elements. As previously described in regard to Blocks 135 of FIG. 12A and 235 of FIG. 12B, it is convenient to also store at this time a diameter or other measurements associated with the electrode distance r for this particular signal pair. As before, the orientation information is obtained from the inclinometer and also stored; the displacement court indicator J is also incremented, but now, an additional indicator NPC is also incremented to count the number of possibly corresponding elements which were actually considered on SIG2 for the Ith signal element on SIG1.

The process returns to Block 336 of FIG. 12C now to accumulate the sum of all of the considered quality factors which of course may be accomplished by adding the QAL associated with the properly identified displacement to the previous value of SUM, as indicated in Block 336. Then, as would be the case if the test indicated in Block 332 answered NO, a test is made to see if I corresponds to N, indicating that all of the N possibly corresponding elements have been considered. If two or more possibly corresponding elements are present, this test will initially answer NO and I is incremented as indicated in Block 338, the process returning to Block 330 to consider the next possibly corresponding element on SIG2 as described above.

When all N possibly corresponding elements have been considered as possibly corresponding to the first located signal element on SIG1, the test indicated in Block 337 of FIG. 12C answers Yes and the number of actually considered possibly corresponding elements is now known and indicated by NCP. Thus, as indicated in Block 339, it is possible to normalize the quality factors associated with these elements and previously stored as the last NPC QAL values to reflect a higher quality where a lower number of possibly corresponding elements are considered than would be reflected for a larger number of possibly corresponding elements. As indicated in Block 339 of FIG. 12C, the normalizing equation is:

$$QAL(J,SIG1) = \frac{QAL(J,SIG1)}{SUM}.$$

In this manner, each of the previously stored provisional qualities is normalized. Of course, it will be recognized that for only one possibly corresponding element; e.g., NCP=1 and SUM=QAL(J,SIG1), no normalization takes place and the single possible correspondent receives the full weight.

It will be appreciated that several elements may be located on SIG1 which, in this case, results in the test indicated in Block 340 answering YES in the first test, with the process returning to complete the correlation process described above for this next element, beginning again a Block 324. A number of possible correspondents, associated displacements and normalized quality factors along with the other associated values are again obtained for this element unit all of the signal elements on SIG1 have been located and so considered. In this case, the test indicated in Block 340 of FIG. 12C answers NO and the consideration of the elements located on SIG1 is complete, the number of such elements being indicated by the counter J which is stored as indicated in Block 350.

As previously described in regard to FIG. 12B, it may be desirable to consider several signal pairs and, as shown in Block 355 of FIG. 12C corresponding to Block 255 of FIG. 12B, a test is made to see if SIG2 equals a value corresponding to the last considered signal pair. If not, this test answers No and the values of SIG1 and SIG2 are updated as indicated in Blocks 360 and 365, respectively, as previously discussed in regard to the corresponding blocks in FIG. 12B. When all of the desired signal pairs have been considered the test shown in Block 355 of FIG. 12C will answer YES and the process will continue as shown at Point B and illustrated in FIG. 13.

Thus, in review, FIGS. 12A through 12C provide a number of generalized input values to the displacement process which follows. They illustrate how these values may be obtained from a variety of correlation techniques. The essential values are the displacements (at least two from two different intervals within the region but which may be from the same signal pair), and their corresponding orientations or other information which will allow the determination of their orientations, particularly as expressed by the angle $\phi'$ which has been previously discussed and as indicated in FIGS. 7A and 7B.

The desired optional values include the quality factors and displacement errors associated with the displacement determination. Optional but useful in converting the results of the displacement processing technique to more conventional dip and azimuth values is the diameter or electrode spacing r associated with displacements. In a simple case of a constant-diameter circular hole, these values are constant. With the above-described generalized input, the particular details of the corresponding displacement processing technique will now be described as they are shown in FIGS. 13 and 14, which begin at Point B, indicated as Block 370 in the preceding figures and now in FIG. 13.

The displacement processing which follows has been generally described in regard to the steps following Point B indicated at 70 in FIG. 1 and in Blocks 74 through 80. After some preliminary initializing steps, each displacement is represented by a line in Plane P corresponding to all the possible dips which may be associated with the particular displacement. When the displacement error is associated with the displacement, the width of the line representation may be varied accordingly, in which case, the equations for the boundaries of the line are used to define the displacement representation. When a quality factor is associated with each displacement, this quality is used as a weight and distributed over the width of the line. This weight is accumulated in each of the accumulators or cells crossed by the line representation.

When all of the displacements have been so processed, which, it will be recalled, were obtained from at least two intervals in a defined region, the accumulated weights in each of the counters or cells corresponding to the divisions of Plane P (and which were illustrated in FIG. 11A) are analyzed to determine the location of the cell which accumulated the maximum weight. The weight accumulated in each of the individual cells, of course, is a function of the number of lines which touched or intersected the cell and the line weights assigned to each of the lines. The line weights of course reflect the variation in quality of the displacement determination and also, if the line width was varied, the displacement error associated with the displacement determination. As a precaution, the average weight accumulated in the cells may be determined and used to assure that the maximum weight is significantly distinct.

The position of the maximum weight is considered as indicating both the dip and azimuth of the formation, the dip being reflected by the distance between the cell and the center or point in Plane P corresponding to the mean borehole axis, while the azimuth being reflected in the angle between the North direction and the direction of the maximum weight cell.

Referring now to FIG. 13, beginning at Point B thereof which continues from any of the alternative displacement input processes illustrated in FIGS. 12A through 12C, Block 380 corresponds to initializing or zeroing all of the cells here indicated as CELL (I,J) used as divisions of Plane P. As illustrated in FIG. 11A, this would include varying I from 1 to M as well as J from 1 to M, and thereby setting each of the elements in the CELL array to O. Also initialized in SUMW which will be used to sum all the weights entered into all of the cells, SUMD, which may be used to sum the diameters or electrode distances associated with each displacement to better obtain an average or mean value and ND, which will be used to count the number of displacements which have been processed.

Block 390 of FIG. 13 corresponds to 215 and 315 of FIGS. 12B and 12C respectively, except now, no reference to SIG2 is needed, since, as it will be recalled, each displacement is processed independently of each other displacement. Again, the case of the four-pad dipmeter illustrated in FIG. 1 is employed here and, for simplicity of explanation, only the four adjacent displacements are processed at each interval.

Next, as shown in Block 400, the displacement indicator K is initialized and the previously stored value for the particular signal as designated by SIG is retrieved and assigned to JL. As will be recalled in the discussion of Blocks 150, 250 and 350 of FIGS. 12A, 12B and 12C, respectively, J corresponds to the number of displacements identified by the first signal in a signal pair between which the displacement was obtained by any of the correlation methods. Thus this previous J and now JL value indicates the last displacement identified with each signal pair and therefore may be used to switch the process from one signal pair to the next signal pair.

Displacement processing specifically begins at Block 410 of FIG. 13 with the computation of the equation for the line borders B1 and B2 which may be used to define the edges of a line of varying width used to represent the displacement in Plane P. It will be recalled that two ways of determining these border lines were discussed, one by varying the length of the line l shown in FIGS. 7A through 7C and the other by utilizing a normal dipmeter displacement computation procedure but providing the required two displacements and computing the dip vector normal to the dip plane. In this latter procedure, a standard or dummy displacement is artificially provided as if it had been determined between SIG1 and any of the other signals except SIG2. If, for example, the displacement was determined between SIG1 as signal 1 and SIG2 as signal 2, then the dummy displacement could be taken either on signals 1 or 2 and in fact, could be taken on the borehole axis, providing that dip vector computation procedures would correctly consider such a displacement. As discussed in regard to Fig. 8, two equal but opposite dummy displacements which are usually substantially larger than the actual displacements are utilized, each providing one point on each of the two borders of the displacement representation line.

When, as indicated in Block 410 of FIG. 13, the computation of the equation for a line border utilizes the method described in regard to FIGS. 7A through 7C, where the equation for the line can be directly derived from the actual displacement without the use of the dummy displacement, the following equation may be used:

$$x \cos(\phi') + y \sin(\phi') = d_{A-B} \qquad \text{(EQ. 5).}$$

Thus, for line border B1, this equation becomes:

$$x \cos(\phi') + y \sin(\phi') = \text{DIS(K,SIG1)} + \text{DER(K,SIG1)};$$

and for line border B2, it becomes:

$$x \cos(\phi') + y \sin(\phi') = \mathrm{DIS(K,SIG1)} - \mathrm{DER(K,SIG1)}.$$

It will be recalled that the line length l is directly related to displacement and in this case, when adjusted for ±e, the displacement error, the difference in l for B1 and B2 is directly related to the range for the displacement error. As previously mentioned, this error need not be symmetrical, as for example, when this error is determined from a non-symmetrical peak in a correlogram. In this case, two errors, e and e', as illustrated in FIG. 4, are utilized to compute B1 and B2.

In the alternative method of computing the line borders illustrated in FIG. 8, which employs four vectors, the components of these vectors may be obtained from the equations for x and y previously given in regard to this figure, and in deviated holes, in regard to FIG. 9.

The components of each vector shown in FIG. 8 may then be used to obtain the corresponding components in Plane P, which provide the x and y coordinates of the vector intersection point in this plane. With the x and y coordinates of two such points on a line in Plane P, the equation of the line may be readily obtained.

The computation of the equation for the line borders illustrated by Block 410 of FIG. 13 may be performed, utilizing the positions on Plane P of four points corresponding to Points $R_1$ through $R_4$ as shown in FIG. 8 and previously discussed, where the x and y coordinates in Plane P of these points may be derived from the equations:

$$x = H \tan(\Delta) \cos(\phi') \qquad \text{(EQ. 5A)}$$
$$y = H \tan(\Delta) \sin(\phi'),$$

where the Δ corresponds to the apparent dip angle resulting from combining the actual displacement with the dummy displacement and $\phi'$ corresponds to this dip azimuth. Using the above Equation (5A), the coordinates of two points on each border; e.g., $R_1$ and $R_2$ may be obtained and the equation for the border line derived using well known two-point equations.

With the position of the line representing a displacement now defined by equations, the line weight LW may be computed as indicated in Block 420 of FIG. 13. As previously discussed, depending upon whether the quality and/or displacement error values associated with the displacement are available, heavier line weights or increasing line intensities correspond to better quality displacements which, when accompanied by the displacement error, is distributed over a corresponding width of the line. When no displacement error is available, a constant line width may be used to vary LW directly with the quality QAL. When no quality is available, a constant QAL value may be used and LW varied inversely with the displacement error DER. Thus, as indicated by the relation shown in Block 420, LW may be derived accordingly.

As indicated next in Block 425 of FIG. 13, two parameters indicative of the cell array used to divide Plane P and previously illustrated in regard to FIGS. 11A and 11B are initially defined. It will be recalled that the index I corresponds to one edge of this cell array and that XB corresponds to the range for displacements or possible dip representations covered by one-half the edge length of plane P. Thus, this initialization of I and X corresponds to starting at one edge of Plane P. Next, as indicated in Block 430, the Y intersection points Y1 and Y2, are computed for the current value of X from the equations for borders B1 and B2. Referring now to FIG. 11B, where these values are illustrated, it will be apparent that one row of cells touching the line may be defined from these X and Y values. Thus, by progressively increasing X and solving for the Y intersections, all the cells within the line borders or touching them may be defined. It is not critical how these cells are specifically identified but the procedure illustrated in FIG. 11B and described hereafter may be used, for example.

As indicated in Block 430, it is convenient to note the direction (SIGN) the y coordinate moves when going from B1 to B2. This may be obtained from the ratio of the absolute difference between Y2 and Y1 with the actual difference (including its algebraic sign) as illustrated in Block 430. After noting this direction as SIGN, an initial value of Y is taken as Y1 as shown.

Of course, it is possible, particularly with lines which parallel the x axis in the illustrated method, to find Y values which exceed the limits of Plane P. This possibility is considered as shown in Block 435 by testing to see if Y is included on Plane P and if not, this test answers NO and the process indicated in Block 440 is bypassed. If Y is on Plane P, the test answers YES, and as shown in Block 440, the J index corresponding to Y is computed. J is biased by M/2 (½ the range of J) and Y scaled by M/2YB (where YB corresponds to one-half of the Y range). With I already defined and J now defined, the cell corresponding to the current values of X and Y is now CELL(I,J). As indicated in Block 440, the previous contents of this cell is increased by LW, corresponding to the accumulation of the line weights which intersected this cell. Also shown in Block 440 is the accumulation of the LW values placed in all cells by adding LW to SUMW.

The previously computed direction of Y from B1 and B2 is now utilized, as shown in Block 445, to move the current value of Y to correspond to the next cell touched by the line. Thus, if SIGN is positive, Y is increased by ΔY and checked for exceeding the range of Y2+ΔY as shown respectively in Blocks 450 and 452. If SIGN is negative, Y is decreased by ΔY, checked against Y2−ΔY as respectively shown in Blocks 460 and 462. This use of Y2±ΔY, as will be appreciated by inspection of FIG. 11B, allows including cells which may be only partially covered by the line. If the new value for Y corresponds to a cell which is even partially covered or touching the line, the tests indicated in Blocks 452 and 462 answer YES and this next Y value is then processed as previously indicated, beginning at Block 435.

If, however, this new value of Y is found to be far enough beyond the B2 boundary, as indicated by the test in Blocks 452 or 462 answering NO, the process continues as indicated at Block 470 of FIG. 13 by increasing both the I index and the corresponding X axis value. A unit increase of I corresponds to a ΔX increase of X, and similarly for J and ΔY. This new X value is now checked as indicated in Block 475 to see if it might also exceed the dimensions of Plane P. If not, the test indicated in Block 475 answers YES and the process continues with this I and X value to begin again at Block 430 as previously discussed. If X is off Plane P, the test indicated in Block 475 answers NO, which indicates the end of the above CELL determination procedure.

Next, as indicated in Block 478 of FIG. 13, it is convenient to accumulate the sums of the diameters and count the number of displacements already processed. This may be done by adding the current diameter DIAM to SUMD and incrementing ND, as shown therein.

Then, as indicated in Block 480, the indicator K corresponding to the last displacement on SIG which has just processed, is checked against the total number JL of displacements known to be present for the signal combination identified by SIG. If further displacements remain for this signal pair, the test indicated by Block 480 of FIG. 13 answers NO and a new value of K corresponding to the next displacement is obtained as shown in Block 482. This displacement is processed as described above, beginning at Block 410.

If the last processed displacement indicated by K equalled JL, the test indicated in Block 480 of FIG. 13 would answer YES and a test would be made as indicated in Block 485 to determine if the last signal pair had been processed. In this particular case, this would correspond to SIG=4, the number of signal pairs considered in this illustrative case. If only one out of the four illustrated pairs have been processed, this test would answer NO and, as shown in Block 495, the next signal pair designated by SIG would be considered by beginning the process again at the previously discussed Block 400.

If all signal combinations desired, as illustrated by SIG=4, have been processed, the test indicated in Block 485 of FIG. 13 answers YES and the process continues at Point C also shown in FIG. 14.

In review, all of the displacements previously input in the displacement processing technique have been now represented by lines corresponding to all possible dips. Their corresponding line weights have been accumulated in each of the cells intersected by these lines. All that remains to be done in the displacement processing technique is to find the particular cell corresponding to the highest density of line intersections, which in terms of the above process, corresponds to the cell with the highest accumulation of line weights. Several ways of determining this position may be used, including tracking the position of the cell containing the maximum weight as these weights are accumulated, as for example, in conjunction with Block 440 of FIG. 13. However, as illustrated in FIG. 14, a straightforward and relatively simple process will be described.

Refer now to FIG. 14 beginning at Point C which continues from this same point from FIG. 13. As shown in Block 505 of FIG. 14, two indicators, are initialized, MAX to 0 and I to 1, to begin the process of scanning all of the cells used to divide and represent Plane P. Then as indicated in Block 510, the indicator J is also initialized to 1. It will be recalled as illustrated in FIG. 11A, that Plane P is divided into cells which may be indexed by these I and J indices, with these indices ranging between 1 and M.

The cell designated by CELL (I,J) is then compared as shown in Block 515 with the previous value of MAX. If the accumulated weights in this cell exceed MAX which would most certainly be the case in all but empty cells when MAX=0 as initialized in Block 505, the test indicated in Block 515 answers YES. In this case, the process continues as shown in Block 520 of FIG. 14 by updating MAX with the accumulated weight represented by the contents of the CELL (I,J). The position of the cell is noted by retaining the corresponding I and J index values respectively as IMAX and JMAX. With the position of the current maximum weight cell now defined, the process continues as if the test indicated in Block 515 had answered NO corresponding to a cell which did not exceed the contents of a prior maximum weight cell.

Next as shown in Block 525, the index J is compared with its maximum range M and if this has not been reached, this test answers NO and as shown in Block 530, J is increased and the next corresponding cell is considered as described above beginning at Block 515. If, however, as indicated by the test shown in Block 525 of FIG. 14 answering YES, the limits of the J index have been reached, a corresponding test is made on the I index as shown in Block 530. Similarly, I is increased as shown in Block 540 and J initialized to 1 as shown in Block 510 to consider a new group of cells in the above process. Finally when the tests shown in both Blocks 525 and 530 of FIG. 14 answer YES, indicating that the complete array of counters or cells used to divide Plane P have been considered, the process continues as shown in Block 550 t0 compute some average values corresponding to all of the above processed displacements. As previously discussed, it is convenient to compute the average or mean diameter AD by dividing the previously accumulated sums of all these diameters SUMD by the number of displacements ND, this value being useful where the borehole diameter varies from displacement to displacement. Also computed is the average weight AW in each of the cells which may be obtained by dividing the previously summed weights SUMW by a number of cells used which, of course, corresponds to M×M for a square array.

Next, as shown in the test indicated in Block 555 of FIG. 4 and previously discussed as one possible way of assuring that the maximum accumulation of weights is sufficiently distinct from the weights accumulated in other cells, the maximum accumulated weight now stored at MAX less a weight threshold indicated as WS is compared with the average weight AW. Thus, if the accumulated maximum weight MAX does not exceed AW, the average accumulated weight, by at least WS, the test indicated in Block 555 answers NO and no dip or azimuth results are determined as indicated in Block 560. If, however, MAX is sufficiently distinct, the test in Block 555 answers YES and the dip and azimuth results corresponding to the position of this maximum accumulated weight are determined as indicated in Block 570. Recall that the weight threshold WS was input, as previously discussed in regard to Blocks 110, 205 and 305 of FIGS. 12A through 12C respectively.

The computation of dip and azimuth from the position of the cell corresponding to the maximum accumulated weight; i.e., IMAX and JMAX, may be done in two stages, particularly where the borehole deviated from vertical, in which case the Plane P is also inclined from horizontal. The first stage would be to compute, what in such cases would be an apparent dip $\theta'$ and apparent azimuth $\phi'$— the dip and azimuth as it would appear in Plane P. In a second stage these apparent values are correcting for the deviation between the mean axis of the borehole and a vertical axis as illustrated in FIG. 9.

These computations and corrections to produce the true dip $\theta$ and true azimuth $\phi$ are straightforward and well known, which will be appreciated when it is realized that the distance l corresponding to the distance between the origin or borehole axis intersection with Plane P, and the position of the maximum weighted cell, can be readily determined and that distance, when taken in ratio to H as shown in FIG. 7C, corresponds to the tangent of the dip angle. The corrections for rotating the components of apparent dip vector to a true dip vector, if the vector notation indicated in FIG. 9 is employed, are also well known and have been described in the previous description of FIG. 9.

Finally, as shown in Block 575 of FIG. 14 and Block 90 of FIG. 1, the results of the above processing may be output for a later utilization or even further processing, as for example, producing graphic displays well known to the dipmeter art. In addition to the true dip and azimuth values which, of course, are more accurately representative of structural dip than those normally obtained from the prior art, several parameters indicative of the quality of their determination may be desired. For example, the illustrated average diameter, average weight and maximum accumulated weight may be considered, in light of the technique used to derive their values, as indicative of the quality of the results.

If desired, and as indicated in Block 580 of FIG. 14, additional dips for additional regions may be obtained by repeating the process described above by continuing at Point A corresponding to either FIGS. 12A through 12C, depending upon the nature of the source for displacements to be processed or by continuing at Point B in FIG. 13 and the above illustrated steps repeated. If desired, all the displacements corresponding to an entire borehole may be processed in the above fashion.

It will be appreciated by those skilled in the art of dipmeter techniques and computer programming that many of the above detailed steps may be performed in different orders or employing different relationships to accomplish the same functions. It will be recalled that the essential steps have been indicated in FIG. 1. In review the technique is independent of the source of the displacements, any of several signal correlation techniques being appropriate, the details of three approaches being described respectively in FIGS. 12A through 12C. Then as indicated in Block 74 of FIG. 1 and described in detail in regard to the description of FIG. 13, each displacement is represented by all the possible dips which could correspond to this displacement. In the illustrated technique, this representation takes the form of a line in a plane normal to the mean borehole axis. When displacements from two or more intervals have been so represented as indicated in Block 80 of FIG. 1 and described in detail in FIG. 14, it is possible to determine the position corresponding to the maximum coincidence of possible dips and thereafter determine corresponding formation dip and azimuth.

Figure 16:
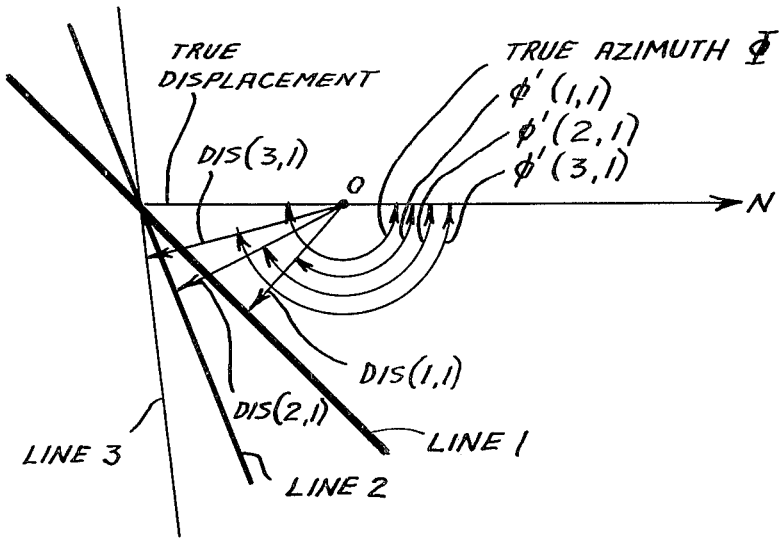
FIG. 16 shows how the different displacements of FIG. 15 may be utilized in accordance with the techniques of this invention to determine the true displacement and therefore true formation dip and azimuth.
Figure 15:
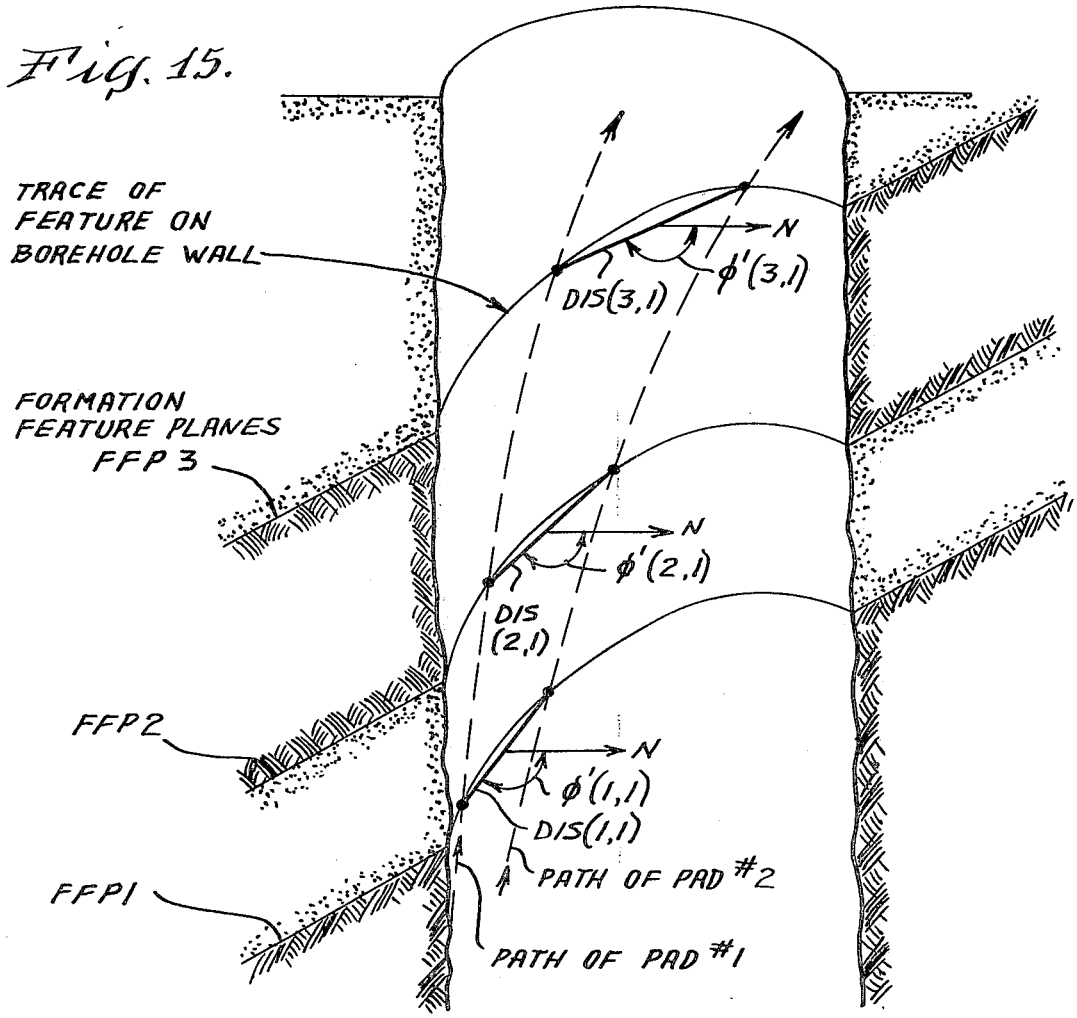
FIG. 15 illustrates how different displacements corresponding to the same formation dip may be obtained between a pair of signals when the borehole dipmeter tool rotates.

Now that it has been disclosed how each displacement is independently processed, refer to FIGS. 15 and 16 where one of the advantages of this disclosed process is illustrated. As previously discussed, it is a feature of this technique to independently consider displacements from more than one level, and in some cases, as a result, it is possible to determine accurate dip and azimuth values from only one signal pair. An example of such case is shown in FIG. 15 where number of formation features are shown to intersect a borehole, these features may correspond to a structural detail of a given geological unit, as for example, to the nearly planar surfaces that commonly result between depositional cycles. Three such formation features are shown and indicated as FFP1 through FFP3. It is common in such structural circumstances for each of these planes or nearly planar surfaces to be also parallel to one another at least over the given vertical region in the depositional sequence.

As a consequence, when two dipmeter electrodes are moved through a borehole penetrating such a formation in a manner which causes rotation with this movement, as illustrated in FIG. 15 by the dashed lines which indicate the paths of two pads—numbers 1 and 2, the displacements determined between signal features corresponding to the formation feature reflected on these signal pairs will vary accordingly. For example, when the orientation of the electrodes is along the strike of the formation, the displacement will approach zero. When the orientation approaches that of the dip of the formation, the displacement reaches a maximum value. This is graphically illustrated in FIG. 15 by the three displacements designated as DIS(1,1) through DIS(3,1) which vary in accordance with their orientation, as respectively indicated as $\phi'$(1,1) through $\phi'$(3,1).

FIG. 16 illustrates the results of processing the displacements illustrated in FIG. 15 in accordance with the techniques of this invention. Shown in FIG. 16 are the three lines designated as lines 1 through 3 which represent the above three displacements. The displacements are shown as corresponding to the length of the lines between the origin 0 and the point of closest approach of their representation line with the origin. As shown by the length of this line, the displacements increase from the first to the third displacement, which, in this case also corresponds to increasing $\phi'$ values. All three lines intersect at a point located at a distance from 0 corresponding to the true displacement and in a direction corresponding to the dip.

It will be now appreciated that had the orientation of the electrode pair rotated into the direction corresponding to this dip, the actual measured displacement would correspond to the true displacement. Of course, it will be also appreciated that without benefits of the displacements processing described herein, there would be no way of detecting that this had occurred.

The advantages of requiring only the two signals illustrated in FIGS. 15 and 16 are most frequently realized in deviated holes where severe instrumentation problems may lead to deriving inferior signals from two or more electrodes. In prior art techniques, this could, in extreme cases, prevent obtaining any dip results whatsoever, or in less extreme cases, cast serious doubts as to the accuracy of these results.

Now reconsider FIGS. 15 and 16 but now add the additional displacements at the different orientations that normally would be obtained between signal derived from other electrode pairs. It becomes readily apparent that the illustrated displacement processing technique allows these additional displacements to reinforce the certainty of the position corresponding to the line intersections shown in FIG. 16, and therefore increase the accuracy of the corresponding true dip and azimuth determination.

Now reconsider the above still again, but add still more displacements as may be obtained from correlating these same signals but now retaining for each correlation, all reasonable displacements that might correspond, for example, to each peak in a multi-peak correlogram, or between a given signal element and each of several possibly corresponding signal elements, and thus including valid displacements, which by reason of apparently inferior quality would have been discarded in the prior art techniques. These additional displacements now, through the features of the present invention, each contribute to the dip determination, each according to its individual integrity, as expressed by whatever quality of accuracy each might possess; perhaps diminished only by normalizing its weight among the number of such possible displacements in each such correlation.

The ability of the disclosed displacement processing technique to utilize, rather than discard, information is quite clear.

The above described embodiments are, therefore, intended to be merely exemplary and all such variations and modifications are intended to be included within the scope of the invention as defined in the appended claims.

What I claim is:

1. In the art of well logging, a process for converting well logging signals which comprise records of the amplitude of subsurface characteristics versus depth in a borehole into a map of the dips of one or more subsurface earth formation features comprising the machine-implemented steps of:

a. utilizing well logging signals derived from respective passes of investigating devices along the wall of a borehole through a subsurface formation to produce signals determined by the likely displacements between the respective reflections of respective subsurface features on said well logging signals in at least two different depth spans in the borehole;

b. producing a map record which conforms to a plane transverse to the borehole axis and contains a number of map line representations the position of each of which on the map record conforms to a range of dips consistent with a respect one of said displacement signals;

c. wherein said displacement signals relate to respective borehole depths within a selected depth interval of the borehole which is small as compared to the depth of the entire borehole; and d. wherein a predominant locus of intersections of such line representations on the map record determines a likely dip of a subsurface feature which is in the borehole depth interval to which said depth displacement signals correspond.

2. The process of claim 1 in which the step of producing the map record includes varying the line representations in accordance with the integrity of the respective displacement signals consistent therewith to enhance the determination of a likely locus, and thereby of a likely dip, of higher integrity as compared to the determination of a likely dip of lower integrity.

3. The process of claim 2 in which the step of varying the line representations comprises varying the intensity thereof to enhance the intensity of a predominant locus and thereby the determination of a likely dip.

4. The process of claim 3 in which: said line representation comprises a line in a plane normal to the axis of the borehole as determined from the position of a borehole tool carrying said investigating devices; the position of a line in said plane is determined by the magnitude and orientation of the respective displacement; and the intensity of a line is varied in accordance with the quality of the respective displacement represented thereby, the intensity increasing with increasing quality.

5. The process of claim 4 in which the step of varying the intensity of a line comprises varying the intensity in accordance with the accuracy of the respective displacement represented thereby.

6. The process of claim 5 in which the intensity is higher for more accurate displacements than for less accurate displacements of the same quality.

7. The process of claim 3 in which: said line representation comprises a line in a plane normal to the axis of the borehole as determined from the position of a borehole tool carrying said investigating devices; the position of the line in the plane is determined from the magnitude and orientation of the displacement represented thereby; and the intensity of the line is varied in accordance with the accuracy of the displacement represented thereby, the intensity increasing with increasing accuracy of the respective displacement.

8. The process of claim 7 in which the step of varying the intensity of a line comprises varying the intensity in accordance with the quality of the displacement represented thereby.

9. The process of claim 8 in which the intensity is higher for displacements of better quality than for displacements of lower quality which have comparable displacement accuracy.

10. The process of claim 1 in which the step of producing a map record comprises producing a map record of said line representations which is on a record medium and is visible by the unaided eye, and which contains at least one observable predominant locus.

11. In the art of well logging, a process for converting geophysical signals which comprise records of subsurface geophysical properties versus depth in a borehole into a map record of the dip of one or more subsurface formation features comprising the machine-implemented steps of:

a. producing at least two signals for respective displacements obtained for respective similar features in respective different borehole depth intervals of at least one pair of geophysical signals derived from a respective pair of signal sources while at known positions in a borehole through a subsurface formation;

b. producing a map record which conforms to a plane normal to the borehole axis and contains a respective line representation for each of said displacement signals, each line representation conforming to a range of possible subsurface formation dips corresponding to the respective displacement signal, said line representations being oriented on the map record according to the respective positions of the pair of signal sources corresponding to the respective displacements; and c. determining the position of coincidence of said line representations on said map record to determine thereby the corresponding dip of a subsurface formation feature reflected on said geophysical signals and producing a tangible record of the last recited dip of a subsurface feature.

12. The process of claim 11 in which the step of producing a map record includes varying the weight of a line representation in accordance with the integrity of its respective displacement signal to increase the weight contributed by the line representation to the determination of the position of coincidence and therefore to enhance the integrity of the determination of the corresponding dip of a subsurface formation feature.

13. The process of claim 12 in which the weight of a line representation is higher for a better quality displacement signal as compared to the weight for a poorer quality displacement signal.

14. The process of claim 12 in which the weight of a line representation is higher for a more accurate displacement signal as compared to the weight for a less accurate displacement signal.

15. The process of claim 12 in which the weight of a line representation is higher for a higher ratio of quality to accuracy of the respective displacement signal as compared to a lower ratio.

16. The process of claim 12 in which the weight of a line representation is varied by varying the width thereof, a wider line representation having less weight as compared to the weight of a narrower line representation which corresponds to a displacement signal of the same quality.

17. A method of machine-converting displacement signals obtained from pairs of geophysical signals derived from signal sources located at respective positions in a borehole penetrating subsurface formations into signals indicative of the dip of one or more subsurface formations reflected on said signals, comprising:

a. producing, for each of at least two different intervals in the borehole, a displacement signal obtained from a pair of geophysical signals derived from signal sources at known positions in the borehole, each displacement signal being determined by the displacement between a reflection on one of the geophysical signals of a pair and a similar reflection on the other;

b. representing a range of possible dips corresponding to each of said at least two displacement signals, each representation of a range of possible dips corresponding to a respective displacement signal reflecting the known positions of the pair of signal sources producing the geophysical signals from which the respective displacement signal was obtained; and c. determining the position of coincidence of said possible dip representations and the corresponding likely dip of a formation reflected on said geophysical signals and producing and storing dip signals indicative of the last recited dip of a subsurface formation.

18. A method as in claim 17 in which the step of representing possible dips includes varying the representation in accordance with the integrity of the represented displacements in order to enhance the determination of the position of coincidence for representations of higher integrity as compared to representations of lower integrity.

19. A method as in claim 18 including representing more than one possible displacement in a given depth interval in the borehole and varying the representation of each such displacement in the interval in accordance with its integrity while also normalizing the variation of the representations for the number of such displacements in the interval.

20. A method as in claim 17 including producing a visible map record of said possible dip representations in which the representations are shown as lines at positions indicative of the possible dips thereof and a predominant intersection of said lines is indicative of said likely dip of a subsurface formation.

21. A method of machine-converting displacement signals obtained from pairs of geophysical signals derived from signal sources at respective positions in a borehole penetrating subsurface formations into dip signals indicative of the relative position of subsurface formation features reflected on said geophysical signals, comprising:

a. using a multiplicity of displacement signals obtained from at least one pair of geophysical signals derived from signal sources spaced around a borehole at respective positions, each displacement signal being related to the positions of a pair of the signal sources in the borehole at the time each receives a respective one of two similar reflections of a subsurface feature;

b. representing each of said displacement signals as a line on a record which conforms to a plane transverse to the axis of the borehole, each line corresponding to a range of possible dips for a respective displacement signal and reflecting the respective positions of the signal sources corresponding to the last recited displacement signal;

c. determining the position of highest coincidence of said lines corresponding to ranges of possible dips; and d. determining from said record the dip corresponding to said determined position of highest coincidence and producing dip signals indicative of the corresponding dip of the subsurface formation features reflected on said geophysical signals.

22. The method of claim 21 in which each of said lines on the record passes by the borehole axis intersection with said plane at a distance which increases with increasing magnitude of the displacement representing by the respective displacement signal.

23. The method of claim 22 in which the step of representing each of said displacement signals as a line corresponding to a range of possible dips includes varying the weight of the line in accordance with the quality of the represented displacement to increase the contribution of a higher quality representation relative to a lower quality representation to the determination of the position of coincidence between said representations and therefore the determination of the corresponding dip of the subsurface formation feature.

24. The method of claim 21 including producing a visible map record of said lines.

25. A system for converting well logging signals comprising records of the amplitude of subsurface characteristics versus depth in a borehole into dip signals comprising a record of the dip of one or more subsurface features comprising:

a. means for utilizing well logging signals derived from respective passes of investigating devices along the wall of a borehole through a subsurface formation to produce displacement signals determined by the likely displacement between the respective reflections of respective subsurface features on said well logging signals in at least two different depth spans in the borehole; and b. means for producing and storing signals defining a map record which conforms to a plane transverse to the borehole axis and comprises line signals defining a number of map line representations the position of each of which on the map record conforms to a range of dips consistent with a respective one of said displacement signals, wherein said displacement signals relate to respective borehole depths within a selected depth interval of the borehole which is small as compared to the depth of the entire borehole, and wherein a predominant locus of intersections of such line representations on the map record determines a likely dip of a subsurface feature which is in the borehole depth interval to which said displacement signals relate.

26. A system as in claim 25 in which the producing means include means for producing a visible map record showing said map line representations.

* * * * *